US008205293B2

(12) United States Patent
Rosenzweig et al.

(10) Patent No.: US 8,205,293 B2
(45) **Date of Patent: *Jun. 26, 2012**

(54) STEAM MOP

(75) Inventors: Maximilian Rosenzweig, Montreal (CA); Vrdoljak Ognjen, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/769,521

(22) Filed: Jun. 27, 2007

(65) Prior Publication Data

US 2008/0066789 A1 Mar. 20, 2008

Related U.S. Application Data

(63) Continuation-in-part of application No. 11/496,143, filed on Jul. 31, 2006, now abandoned.

(51) Int. Cl.
*A47L 13/22* (2006.01)
*A46B 11/08* (2006.01)
*B43M 1/02* (2006.01)

(52) U.S. Cl. ..... 15/320; 15/322; 15/403; 15/410; 15/229.3; 15/229.4; 15/229.7; 15/229.8; 401/1; 401/138; 401/270

(58) Field of Classification Search ..... 15/320, 15/322, 403, 410, 98, 229.3, 229.4, 229.7, 15/229.8; 401/1, 138, 270; *A47L 13/22; A46B 11/08; B43M 1/02*
See application file for complete search history.

(56) References Cited

U.S. PATENT DOCUMENTS 1,720,165 A 7/1929 Bloom
1,799,502 A 4/1931 Colburn
2,053,282 A 3/1936 William
(Continued)

FOREIGN PATENT DOCUMENTS

CH 429 211 A 1/1967
(Continued)

OTHER PUBLICATIONS

Patent Abstracts of Japan, vol. 2002, No. 03, Apr. 3, 2002, Publication No. 2001327449 (Alpha Homes: KK), Nov. 21, 2001.

(Continued)

*Primary Examiner* — David A Redding
(74) *Attorney, Agent, or Firm* — Wolf, Greenfield & Sacks, P.C.

(57) ABSTRACT

A steam mop having a main body having a boiler with a water inlet and a steam outlet positioned therein, a pump having an inlet and an outlet with the pump outlet connected to the boiler inlet, a water container for storing water connected to the pump inlet, and a steam pocket frame connected to the steam outlet, where the activation of the pump pumps water from the water container to the boiler for generation of steam. In an embodiment of the invention, a steam mop having a main body with a boiler, a water container, a mechanical water pump between the boiler and container and at least one side arm connecting the boiler steam outlet to a fabric steam pocket frame. The water pump is actuated by movement of the mop when cleaning to send water to the boiler. The steam pad frame is substantially rectangular with a plurality of baffles in a square grid formation extending outwardly to distribute steam to distribute steam between the baffles. A replaceable fabric pad fits snugly on the frame to distribute cleaning steam to the surface to be cleaned.

25 Claims, 20 Drawing Sheets

U.S. PATENT DOCUMENTS

| | | | | |
|---|---|---|---|---|
| 2,962,975 | A | 12/1960 | Camp | |
| 3,108,312 | A | 10/1963 | Ballantyne | |
| 4,073,030 | A | 2/1978 | Albishausen | |
| 4,074,387 | A | 2/1978 | Arato et al. | |
| 4,327,459 | A | 5/1982 | Gilbert | |
| 4,584,736 | A | 4/1986 | Gremminger | |
| 4,905,712 | A | 3/1990 | Bowlin et al. | |
| 4,910,895 | A | 3/1990 | Rethmeier et al. | |
| 5,165,866 | A * | 11/1992 | Kato | 417/360 |
| 5,988,920 | A | 11/1999 | Kunkler et al. | |
| 6,142,693 | A | 11/2000 | Bruggeman et al. | |
| 6,289,551 | B1 | 9/2001 | Basile | |
| 6,328,543 | B1 | 12/2001 | Benecke | |
| 6,490,753 | B1 | 12/2002 | Chen | |
| 6,571,421 | B1 | 6/2003 | Sham et al. | |
| 6,895,626 | B2 | 5/2005 | Tsai | |
| 7,225,503 | B1 | 6/2007 | Lenkiewicz et al. | |
| 7,266,292 | B1 | 9/2007 | Tsai | |
| 7,380,307 | B2 * | 6/2008 | Tsai | 15/320 |
| 7,458,128 | B2 | 12/2008 | Smith et al. | |
| 2002/0094285 | A1 * | 7/2002 | Paolini et al. | 417/413.1 |
| 2002/0106970 | A1 | 8/2002 | Falla | |
| 2002/0112744 | A1 | 8/2002 | Besseling | |
| 2003/0089383 | A1 | 5/2003 | Biggs | |
| 2004/0134016 | A1 | 7/2004 | Kisela et al. | |
| 2006/0000049 | A1 * | 1/2006 | Rosenzweig | 15/322 |
| 2006/0000241 | A1 | 1/2006 | Rosenzweig | |
| 2007/0130719 | A1 | 6/2007 | Zhou | |
| 2008/0236635 | A1 | 10/2008 | Rosenzweig et al. | |
| 2009/0016916 | A1 | 1/2009 | Rosenzweig et al. | |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 100 15 941 | A1 | 10/2001 |
| DE | 102 05 507 | A1 | 8/2003 |
| DE | 10205507 | A1 | 8/2003 |
| DE | 20 2006 001189 | U1 | 4/2006 |
| EP | 1 027 855 | A | 8/2000 |
| EP | 1 224 899 | A | 7/2002 |
| EP | 1 554 968 | A | 7/2005 |
| EP | 1 974 647 | A1 | 10/2008 |
| FR | 601 312 | A | 2/1926 |
| FR | 709 689 | A | 8/1931 |
| FR | 2 282 252 | A | 3/1976 |
| GB | 1 449 483 | | 8/1973 |
| GB | 2 294 196 | A | 4/1996 |
| GB | 2 416 526 | A | 2/2006 |
| JP | 3108311 | U | 14/2005 |
| JP | 56-071963 | A | 6/1981 |
| JP | 60-188511 | U | 12/1985 |
| JP | 63-181800 | A | 7/1988 |
| JP | 08-071026 | A | 3/1996 |
| JP | 09-253016 | A | 9/1997 |
| JP | 2000-201877 | A | 7/2000 |
| JP | 2001-008878 | A | 1/2001 |
| JP | 2001-309881 | A | 11/2001 |
| JP | 2001327449 | A | 11/2001 |
| JP | 2002-045323 | A | 2/2002 |
| JP | 3096121 | U | 5/2003 |
| JP | 2004-173746 | A | 6/2004 |
| JP | 2004-223022 | A | 8/2004 |
| JP | 2004-244041 | A | 9/2004 |
| JP | 2004337454 | A | 12/2004 |
| JP | 2004337454 | A | 12/2004 |
| JP | 2006-075737 | A | 2/2006 |
| JP | 2006-130050 | A | 5/2006 |
| JP | 2007-513723 | T | 5/2007 |
| JP | 2001-095917 | A | 4/2011 |
| RU | 2000475 | C1 | 9/1993 |
| RU | 2062356 | C1 | 6/1996 |
| SU | 866276 | A1 | 9/1981 |
| SU | 1379495 | A1 | 3/1988 |
| WO | WO 98/23385 | A | 6/1998 |
| WO | WO 99/26522 | A | 6/1999 |
| WO | WO 02/43550 | A | 6/2002 |
| WO | WO-2004/062457 | A2 | 7/2004 |
| WO | WO 2007/065371 | A | 6/2007 |
| WO | WO-2008/016741 | A2 | 2/2008 |
| WO | WO-2008/016761 | A2 | 2/2008 |

OTHER PUBLICATIONS

Euro-Pro Operating LLC; Steam Shark II Owner's Manual Model EP908EF; Nov. 2003; St. Laurent, Quebec H4S 1A7, pp. 1-39.

Euro-Pro Operating LLC; Portable Shark Steam Cleaner Owner's Manual Model SC505; Jan. 2003; p. 7; Champlain, NY 12919, pp. 1-11.

USPTO Final Office Action mailed Jul. 1, 2009, in regards to Co-Pending U.S. Appl. No. 11/496,143.

Amendment to Accompany RCE filed Sep. 11, 2009 in Response to Final Office Action mailed Jul. 1, 2009, Co-Pending U.S. Appl. No. 11/496,143.

International Search Report and Written Opinion for PCT/US2007/069470 mailed Feb. 12, 2008.

International Preliminary Report on Patentability for PCT/US2007/069470 mailed Feb. 12, 2009.

International Search Report and Written Opinion for PCT/CN2006/003342 mailed Mar. 15, 2007.

International Preliminary Report on Patentability for PCT/CN2006/003342 mailed Jun. 11, 2008.

International Search Report and Written Opinion for PCT/US2007/072908 mailed Jan. 23, 2008.

International Preliminary Report on Patentability for PCT/US2007/072908 mailed Feburary 12, 2009.

Non Final Office Action for U.S. Appl. No. 11/496,143 mailed Dec. 30, 2008.

Non Final Office Action for U.S. Appl. No. 11/496,143 mailed Oct. 16, 2009.

Non Final Office Action for U.S. Appl. No. 11/496,143 mailed Apr. 30, 2010.

Non Final Office Action for U.S. Appl. No. 11/608,819 mailed Nov. 3, 2008.

Non Final Office Action for U.S. Appl. No. 11/608,819 mailed Sep. 16, 2009.

Non Final Office Action for U.S. Appl. No. 11/608,819 mailed May 26, 2010.

Non Final Office Action for U.S. Appl. No. 12/237,085 mailed Jun. 12, 2009.

Final Office Action for U.S. Appl. No. 12/237,085 mailed Mar. 2, 2010.

Office Action for Chinese Application No. 200780034035.5 issued Dec. 9, 2010.

Notice of Allowance mailed Nov. 23, 2010 for U.S. Appl. No. 11/608,819.

Office Action for Russian Application No. 2008128011 issued Oct. 15, 2010.

Office Action for CN Application No. 200680051301.0 mailed Jul. 12, 2010.

Office Action for Japanese Application No. 2008-543637 issued May 25, 2011.

* cited by examiner

STEAM MOP

CROSS-REFERENCE TO RELATED APPLICATIONS

This is a continuation-in-part of U.S. application Ser. No. 11/496,143, filed Jul. 31, 2006.

BACKGROUND OF THE INVENTION

The invention relates generally to a steam mop, and more particularly to a steam mop including a water pump that is actuated by the movement of a user to pump water from a reservoir to a boiler for generating steam to be distributed to a steam nozzle coupled thereto and pad for application to a surface to be cleaned.

Conventional mops have been widely used for cleaning floors. However, conventional mops have not been effective at cleaning dirt in small crevices and floor gaps. In addition, conventional mops require frequent rising since mops can only effectively clean a small surface area at a time.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water that is connected to an electrical water pump with an on/off switch. The exit from the electric water pump is connected to a steam boiler with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

In general, the nozzles used with the steam cleaners do not have large surface areas and a cloth to absorb the liquid condensate of the steam. Here, the fabric pad is secured to the nozzle by Velcro strips to a plurality of cleats on the bottom of the nozzle. In another embodiment, a flat fabric piece is folded around a flat brush or nozzle in order to increase the cleaning surface area. The folded fabric on top of the brush or nozzle is secured by a clip on top of the piece. Often steam injected behind the cloth passes through the cloth at the points the bristles contact on the cloth. This tends to wet the cloth and reduce the cleaning effectiveness of the steam. In addition, the cloth covers must be carefully attached not to cover the front or back of the brush attachment.

Notwithstanding the wide variety of steam generating appliances available, there exists the need to provide an efficient, compact and easy to use steam mop that will effectively improve the effective steaming surface area of the steam cleaners. It is desirable to provide this device with the ability for a user to clean a larger surface area easily without worrying about wiping up the liquid condensate of the steam when cleaning flooring, furniture and other household items.

SUMMARY OF THE INVENTION

Generally speaking, in accordance with the invention, a steam mop having a water pump for selectively injecting water from a reservoir to a boiler in response to the push-pull movement of the mop is provided. The mop includes a housing with an electric boiler and a water pump wherein a user's back and forth movement of the mop pumps water to the boiler for distribution of steam to a steam pad frame attachment for cleaning. A fabric steam pad is mounted on the steam pad frame to provide an improved cleaning surface.

The steam cleaner in accordance with the invention has an elongated housing hingedly connected to a steam pad frame. The steam pad frame is operatively connected to the boiler. In one embodiment, water is stored in a water tank formed as part of the elongated housing. Water is pumped to the boiler only when a user pushes on the handle for generating steam to be fed to the steam pad frame.

In one embodiment, the steam pad frame is substantially rectangular with a plurality of baffles in a square grid formation extending outwardly from a steam outlet toward the four sides of the steam pad frame to the cleaning surface. The steam pad frame includes a central steam outlet where the square grid formation of the baffles direct steam into the space between the baffles and to the surfaces of a fabric steam pad mounted on the frame. The fabric steam pad is a substantially rectangular pad with fasteners or Velcro strips at the top side of the pad for fastening on the frame for easy installation. The steam pad frame is hingedly connected to the elongated housing. When steam is injected into the pad, the entire surface area of the fabric may be used to steam clean a surface. A fabric steam pocket is mounted on the steam pocket frame to provide a improved cleaning surface where the steam pocket frame is connected to the boiler by at least one pivotally attached side arm. This allows the frame to be flipped over to provide an additional cleaning surface. In another embodiment, there are two side arms also allowing the frame to be flipped over. This allows the mop to be used backward or forwards and is easy to use by both right or left handed users.

In a another embodiment, water maybe stored in a water tank formed as part of the handle. Water is pumped to the boiler only when a user pushes on the handle for generating steam to be fed to the steam pocket frame through the side arm.

The steam pocket frame is substantially rectangular with a plurality of baffles extending substantially perpendicular to the cleaning surface on both upper and lower surfaces thereof. The steam pocket frame includes a central passageway extending perpendicular to the baffles that has openings between the baffles to direct steam into the space between the baffles and up to the surfaces of a fabric steam pocket mounted on the frame.

The fabric steam pocket maybe two layers of fabric joined at three edges with fasteners at the open edge for fastening over the frame, or one layer of fabric wrapped around the frame and Velcro strips on the front or back (or left or right) longitudinal side of the frame for easy installation over the frame. The steam pocket frame is operatively connected to the steam cleaner outlet pipe. When steam is injected into the pocket, the entire surface area of the fabric may be used to steam clean a surface.

Accordingly, it is an object of the invention to provide an improved steam mop and steam pad frame attachment.

Another object of the invention is to provide a steam mop and steam pocket frame attachment to provide increased steam cleaning surface area.

A further object of the invention is to provide a steam mop with a mechanical pump that is actuated by the user's movement of pushing the mop forward and pulling backward to clean and does not need a high steam pressure system.

Yet another object of the invention is to provide a fabric steam pad that is easily mounted on a steam pad frame.

Yet a further object of the invention is to provide a steam pad frame attachment with a fabric pad that does not allow steam to escape at points of contact with brush bristles.

Still yet another object of the invention is a fabric steam pocket that can be used for dual side cleaning.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
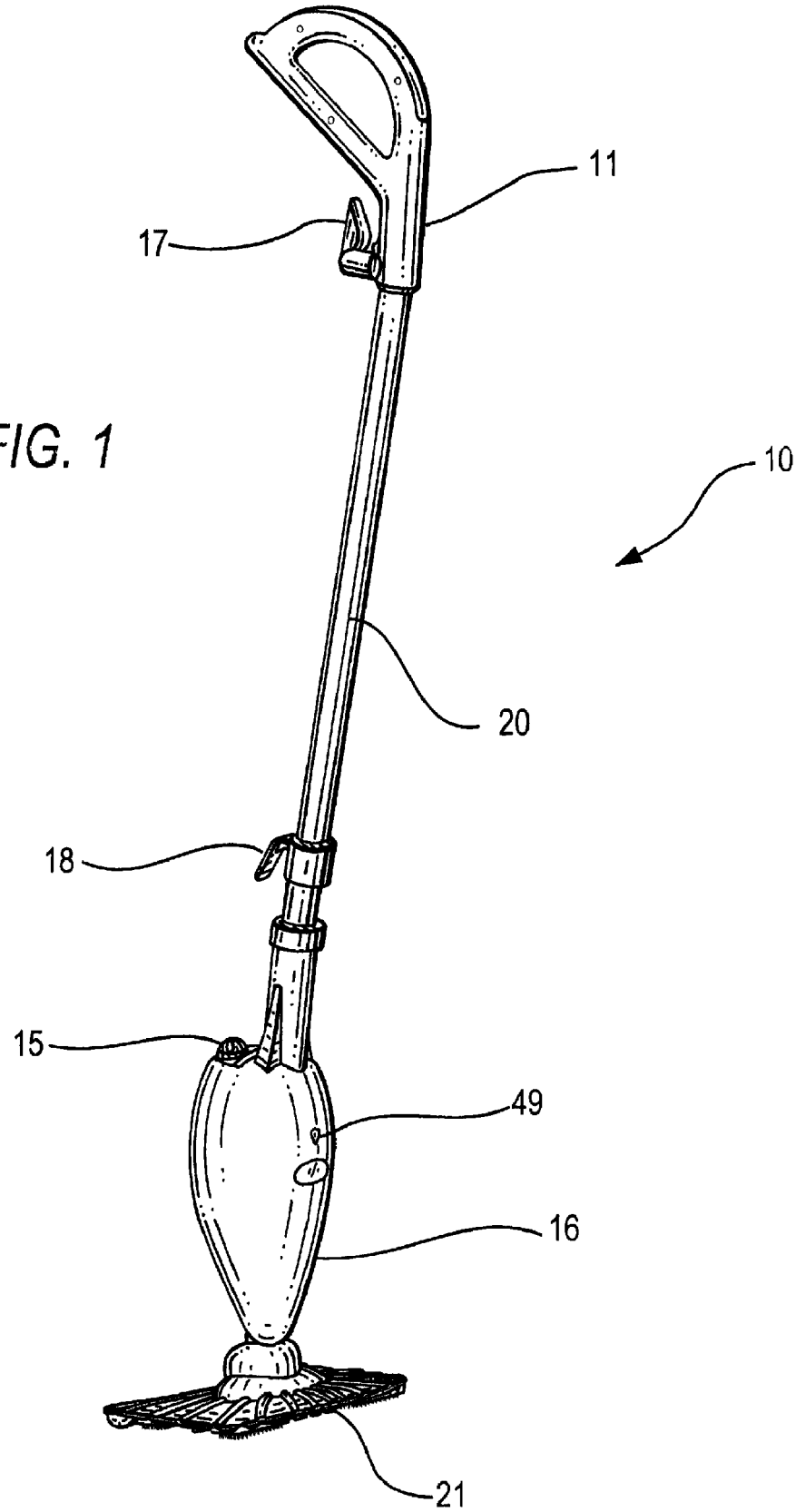
FIG. 1 is a perspective view of steam mop including a steam pad frame attachment for receiving a fabric steam pad constructed and arranged in accordance with the invention.
Figure 2:
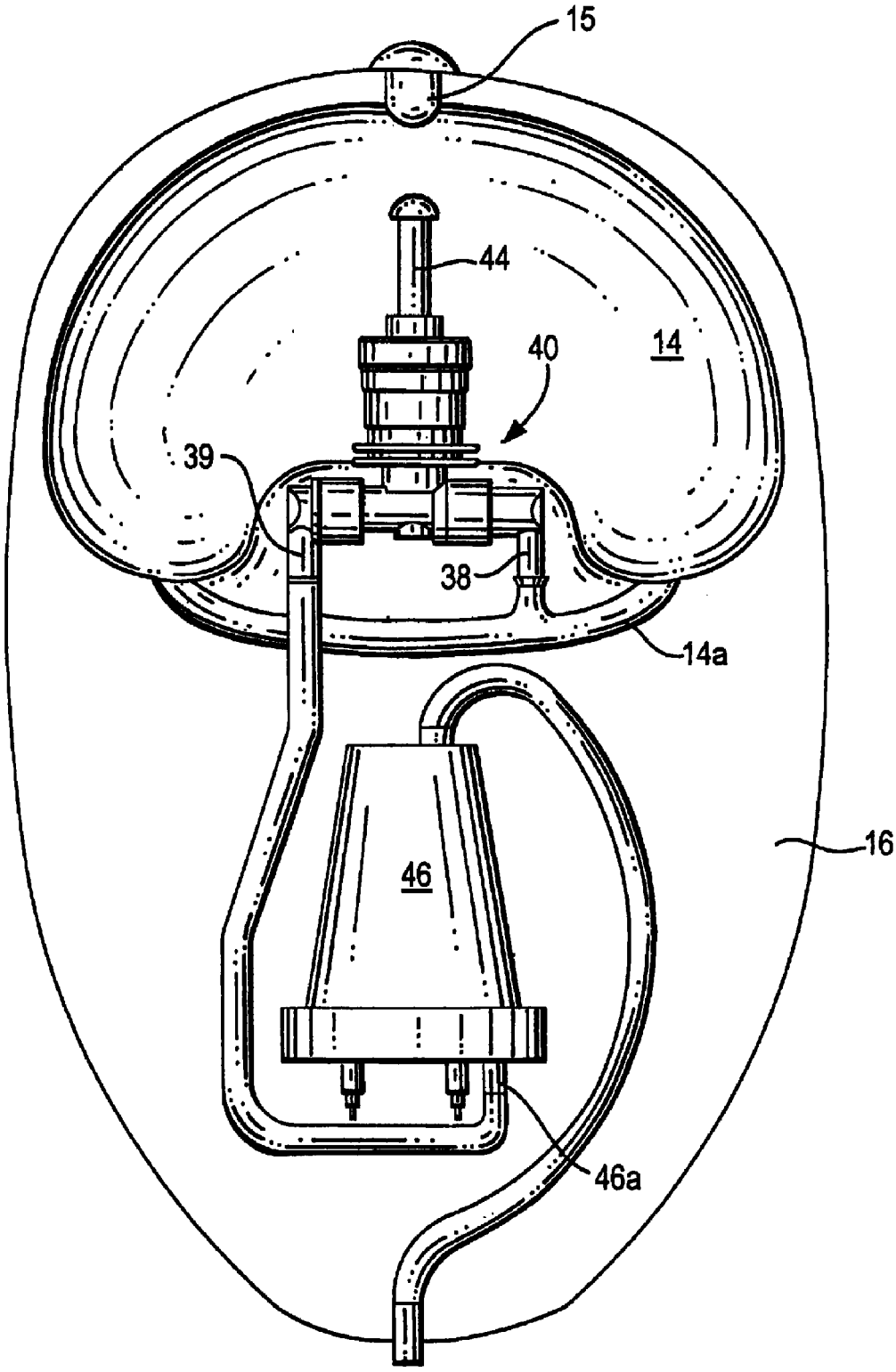
FIG. 2 is a front plan view of the housing and showing the reservoir, pump and boiler of the steam mop of FIG. 1.

FIG. 1 is a perspective view of a steam mop 10 constructed and arranged in accordance with one embodiment of the invention. Mop 10 includes a housing or main body 16 connected to a steam pad frame 21 at one end of a pipe 20 and having a handle 11 at the other end of pipe 20. Housing 16 includes a water container or tank 14 as shown in FIG. 2 as part of the upper part of housing 16 and is connected to a boiler 46 by a pump 29 having a one-way outlet valve 45. Any type of mechanical pump or some other means of transporting the water to the boiler may be used with steam mop 10. Preferably, pump 29 is a mechanical pump, such as a bellows pump or a piston pump, that is actuated by movement of mop 10 by a user pushing and pulling handle 11 at the end of pipe 20. An upper cord hanger 17 is mounted on handle 11 and a lower cord hanger 18 for easy storage of a power cord 47 is mounted on pipe 20.

Figure 5:
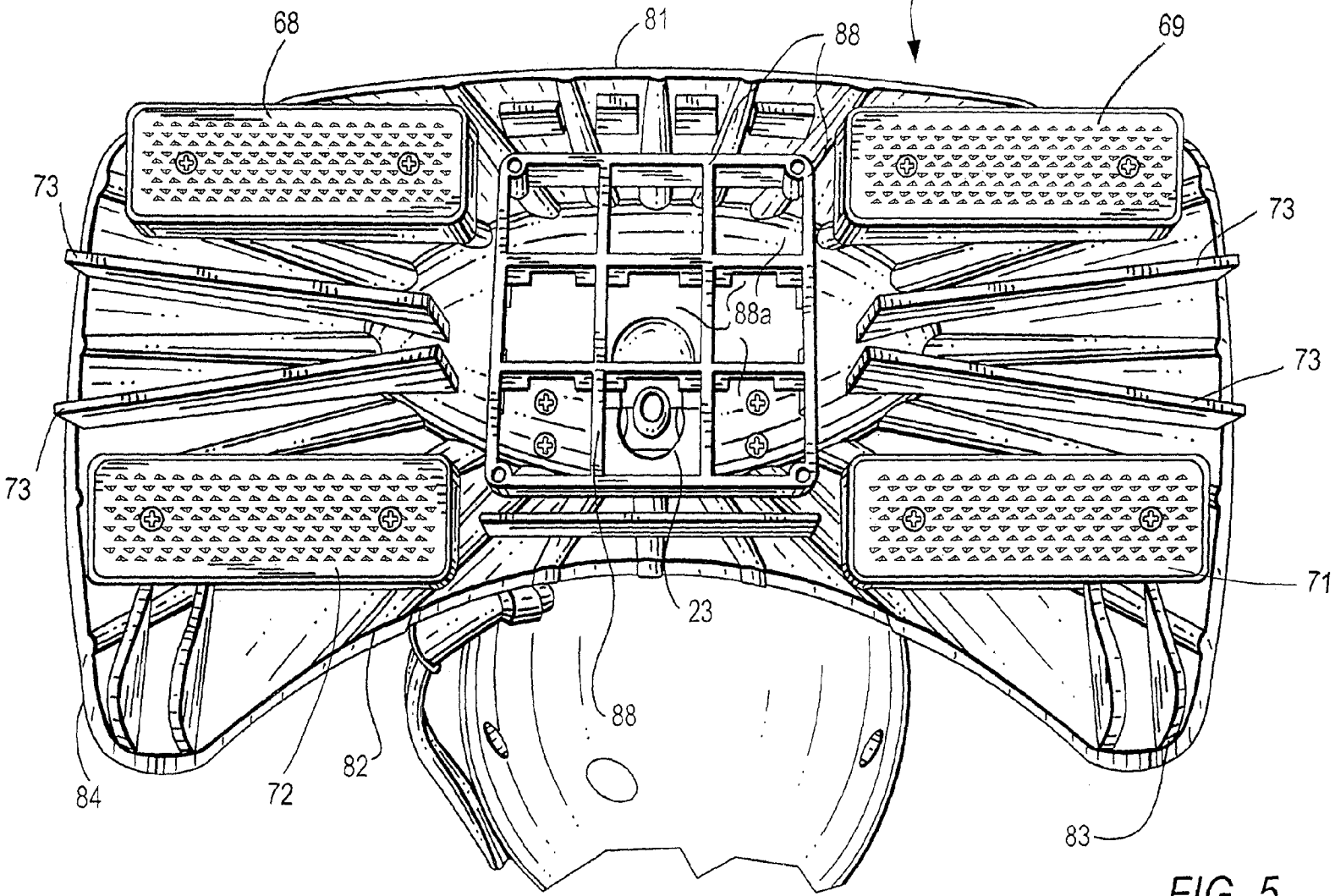
FIG. 5 is a bottom plan view of a steam pad frame for use with the steam mop of FIG. 1.
Figure 6:
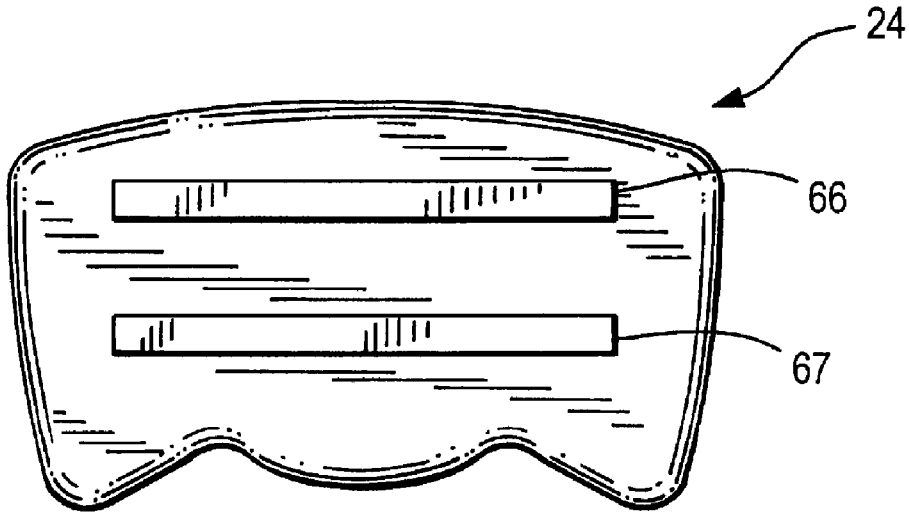
FIG. 6 is a top plan view of a fabric steam pad suitable for use with the steam pad frame attachment of FIG. 1.

Steam pad frame 21 is substantially rectangular in shape and includes a central steam opening 23 as shown on FIG. 5. Steam generated in steam boiler 46 shown in FIG. 2 dispenses steam into frame 21 to central steam opening 23 of frame 21. A substantially rectangular fabric steam pad 24 is mounted on frame 21 by attaching a pair of Velcro strips 66 and 67 to a plurality of cleats 68, 69, 71 and 72 as shown in FIGS. 5 and 6.

Figure 3:
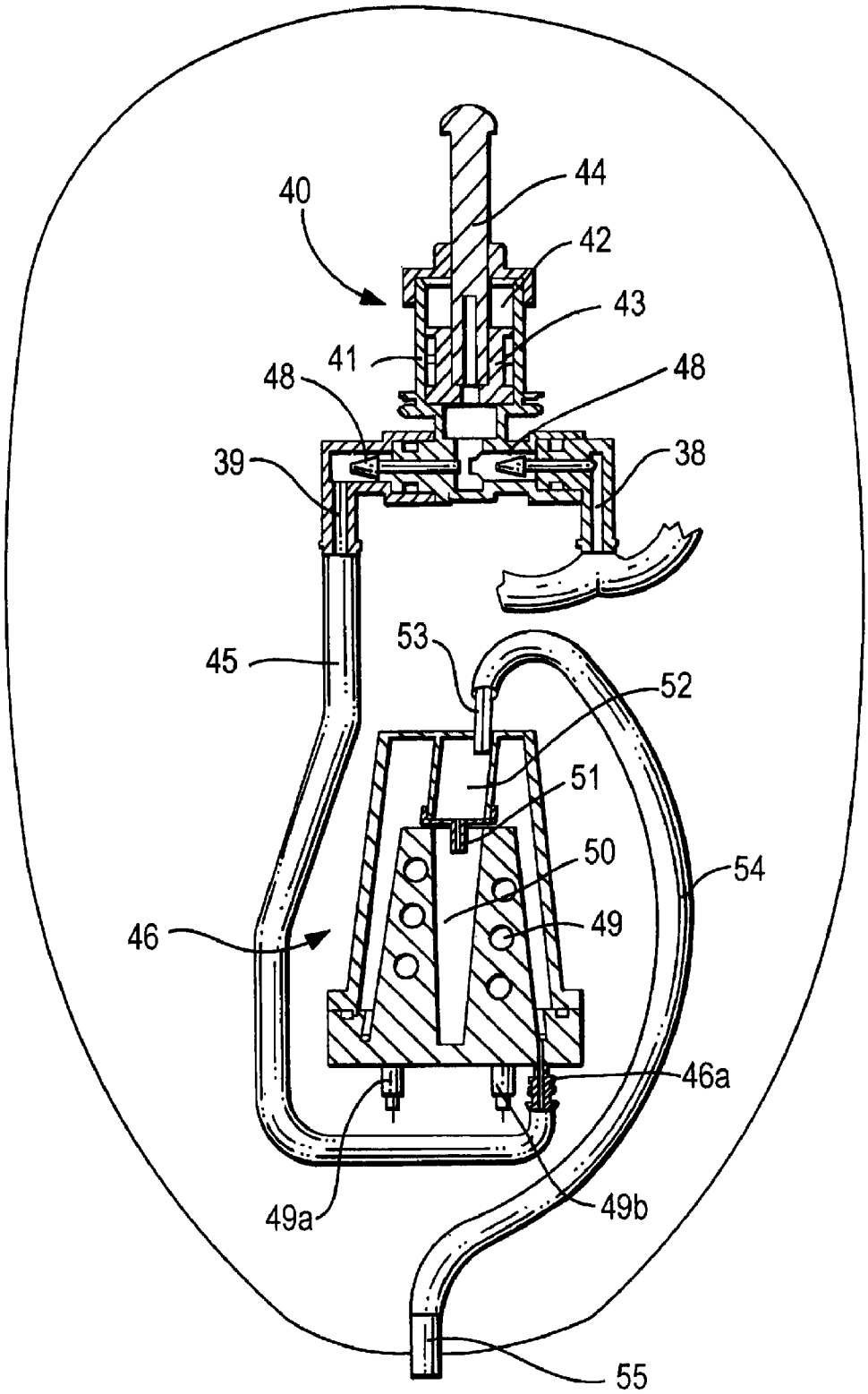
FIG. 3 is a section view of the elements of FIG. 2.

FIGS. 2 and 3 are a front plan and section views, respectively, of the elements in housing 16 of steam mop 10. This includes a water container or tank 14, one-way pump 29 and boiler 46. A water supply hose 40 is connected to a pump water inlet 41. A pump water outlet 39 is connected to boiler 46. Water container 14 includes an opening 15 that may be easily opened and closed for the user to fill water into water container 14.

Water supply hose or water pump 40 includes a pump body 41 having a pump cavity 42. A piston 43 connected to a push rod 44 is positioned in cavity 42. As mop handle 11 is pulled by a user, push rod 44 and piston 43 create a negative pressure in cavity 42. This draws water from tank 14 into a water supply hose 14*a* and into pump water inlet 38. Water is then drawn through a one-way inlet valve 48. As handle 11 is pushed during use, water in cavity 42 is expelled through a one-way outlet valve 45 and pump outlet 39. This pumped water then passes to a boiler inlet 46*a* on boiler 46. Water in boiler 46 is heated by a heating element 49 in a boiler cavity 50 and steam generated is fed through a steam valve 51 into a steam chamber 52. Heating element 49 is connected to electrical connectors 49*a* and 49*b*. Steam is then expelled through a steam outlet 53 to a steam hose 54 and to a frame connector 55.

One-way inlet valve 48 and one-way outlet valve 45 are formed of a flexible elastomeric material, such a rubber. The valves are conical in shape so that when handle 11 is pulled, water is drawn through inlet valve 48 while outlet valve 45 remains closed. Similarly, when handle 11 is pushed, water is forced out through outlet valve 45 and inlet valve 48 remains closed and water is fed into boiler 46.

Figure 4:
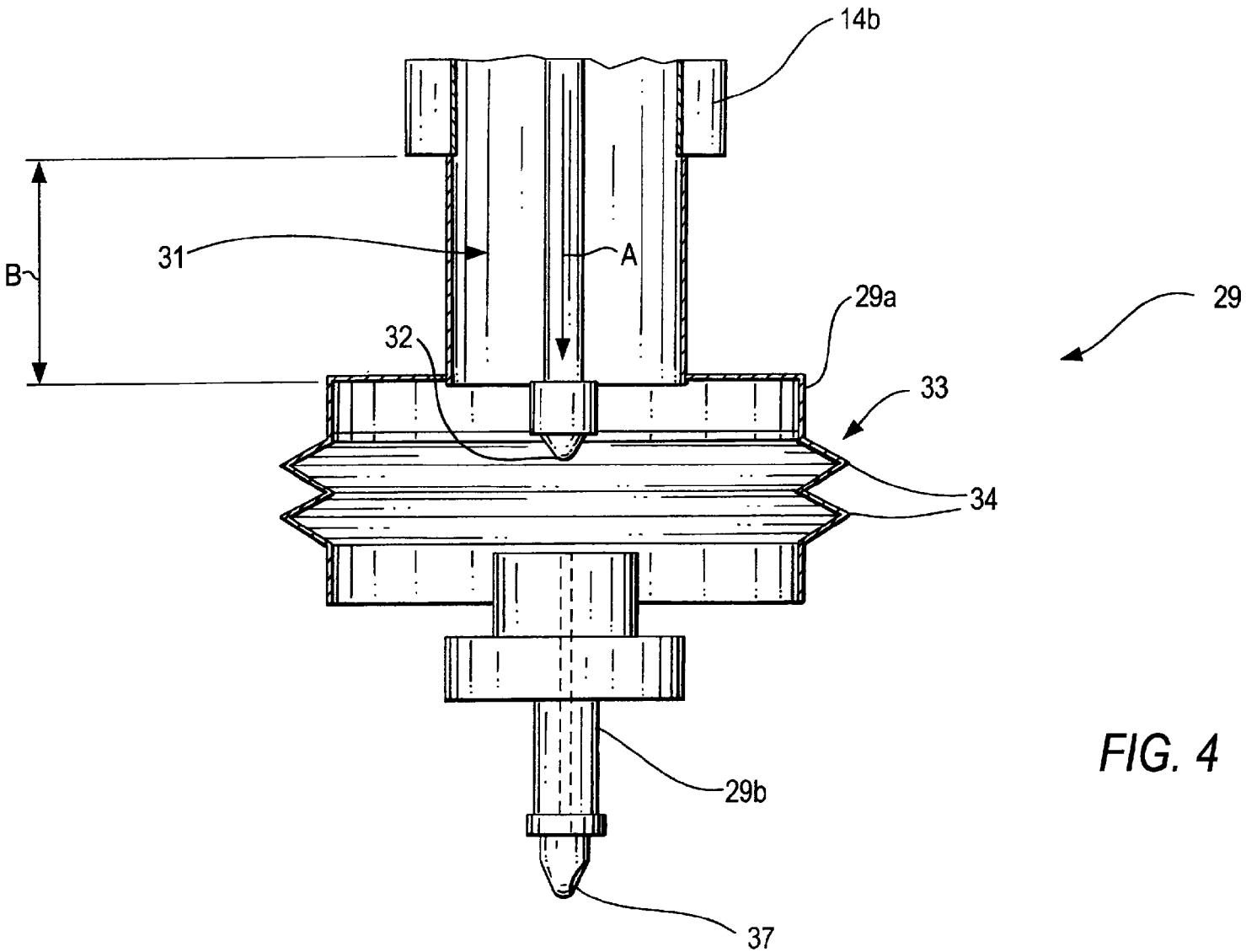
FIG. 4 is a perspective view of a bellows pump suitable for use with the steam mop of FIGS. 1, 9 and 17.

FIG. 4 is a perspective view of an exemplary embodiment of a pump that can be used with steam mop 10. Here, a mechanical bellows pump 29 is shown in FIG. 4 as suitable for use with steam mop 10. Bellows pump 29 includes a pump inlet 29*a* and a pump outlet 29*b*. Bottom portion 14*b* of water container 14 is attached to pump inlet 29*a* through a conduit 31. Arrow A shows the direction of water flow. Pump outlet 29*b* is connected to a one-way duck bill inlet valve 32. Pump inlet 29*a* and pump outlet 29*b* are connected by a cylindrical flexible tubular bladder 33 with a plurality of creases 34. Water can only flow in one direction through valve 33. Pump outlet 29*b* is connected to a second one-way duck bill valve 37 in the bottom portion of bellows pump 29.

Pump 29 operates when conduit 31 is moved up and down by the movement of user so that distance B increases and decreases. When handle 11 is pulled up and distance B decreases, water fills bellows 34. Bellows 34 is compressed as handle is pushed, distance B increases and water is ejected from bellows 34 through second duck bill valve 37 in bottom portion 29*a* of pump 29 and into water conduit 41 and into boiler 46. Accordingly, a user may selectively deliver water to boiler 46 by the movement of pushing the mop forward and pulling the mop backward to clean. If there is no movement by the user, water is not delivered to boiler and steam is not generated. Only when the user moves the mop forward and backward will steam be generated and released. Steam mop 10 is designed as a non-pressurized system. For floor cleaning there is no need for high pressure steam. Cleaning is performed by steam distribution to a fabric steam pad 24 mounted on frame 21.

FIG. 5 is a bottom perspective view of a rectangular steam pad frame 21 including a front wall 81, a rear wall 82, a right side wall 83 and a left side wall 84. A plurality of baffles 88 in a square grid formation extending outwardly from a steam outlet opening 23 toward the four sides of the steam pad frame 21 to the cleaning surface within frame 21. Baffles 88 are planar in shape have a plurality of vents or openings 88*a* between the grids for distributing steam into the spaces between baffles 88 and to a steam pad mounted thereon. Steam pad frame 21 also includes cleats 68, 69, 71 and 72 at each of the four corners of steam pad frame 21. Steam pad frame 21 includes vanes 73 which extend in the direction of walls 83 and 84.

FIG. 6 is a top plan view of a fabric steam pad 24 suitable for use with the steam pad frame 21. Steam fabric pad 24 is configured to attach to frame 21. Fasteners 66 and 67 are fixed to the top side of the steam pad 24. In the preferred embodiment, fasteners 66 and 67 are Velcro-type fasteners. Alternatively, other types of fasteners may be used to secure and hold steam pad 24 in place when used to clean a floor or other surface.

In the illustrated embodiment, steam pad 24 is a cloth or towel. It may be formed of any suitable fabric such as cotton or a synthetic fabric, such as polyester or polyolefin fiber. Preferably, the fabric of pad 24 is a microfiber. Most preferably, the microfiber is a synthetic polyester microfiber.

Figure 7:
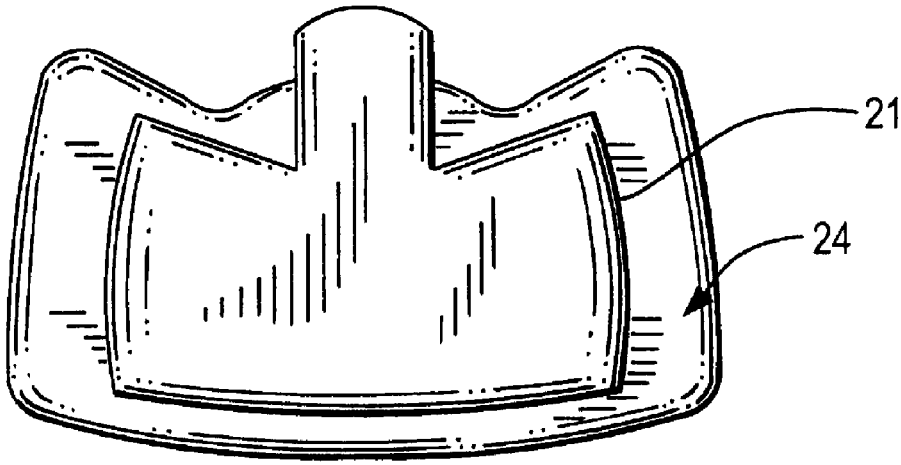
FIG. 7 is a perspective view of the mop of FIG. 1 with a fabric steam pad mounted on the attachment frame.

FIG. 7 is a perspective view of the mop of FIG. 1 with a fabric steam pad mounted on the attachment frame. Here, fabric steam pad 24 is attached to steam pad frame 21 by fasteners (not shown). Also, in this example, fabric steam pad is larger than steam pad frame to provide increased steam cleaning surface area.

Figure 8:
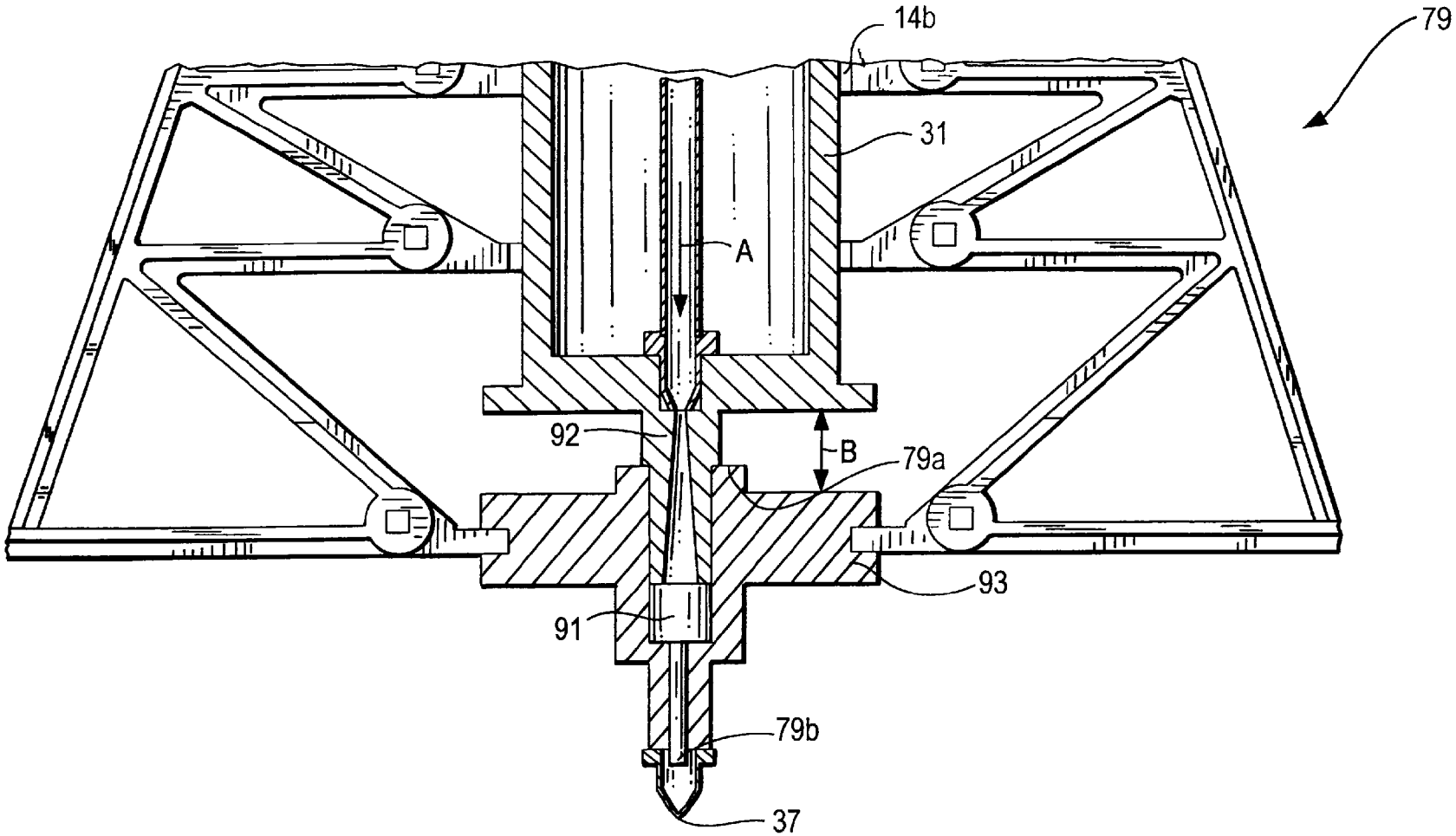
FIG. 8 is a sectional view of a piston pump suitable for use with the steam mop of FIGS. 1, 9 and 17.

FIG. 8 is a perspective view of another exemplary embodiment of a pump that can be used with steam mop 10. Here, a mechanical piston pump 79 is shown in FIG. 7 as suitable for use with steam mop 10. Piston pump 79 includes a pump inlet 79*a* and a pump outlet 79*b*. Bottom portion 14*b* of water container 14 is attached to pump inlet 79*a* through a conduit 31. Arrow A shows the direction of water flow. Pump outlet 79*b* is connected to a one-way duck bill inlet valve 32. Pump inlet 79*a* and pump outlet 79*b* are connected by a sealed movable joint 93 that will allow a piston 92 to move freely inside a cylinder 91 without leaking water in between them. Water can only flow in one direction through valve 32. Pump outlet 79*b* is connected to a second one-way duck bill valve 37 in the bottom portion of piston pump 79.

Pump 79 operates when conduit 31 is moved up and down by the movement of user so that distance B increases and decreases. When handle 11 is pulled up and distance B decreases, water fills the volume space in a cylinder 91. The volume space in cylinder 91 is compressed by piston 92 as handle is pushed, distance B increases and water is ejected from cylinder 91 through second duck bill valve 37 in bottom portion 29*a* of pump 29 and into water conduit 41 and into boiler 46. Accordingly, a user may selectively deliver water to boiler 46 by the movement of pushing the mop forward and pulling the mop backward to clean. If there is no movement by the user, water is not delivered to boiler and steam is not generated. Only when the user moves the mop forward and backward will steam be generated and released. Steam mop 10 is designed as a non-pressurized system. For floor cleaning there is no need for high pressure steam. Cleaning is performed by steam distribution to a fabric steam pocket 24 mounted on frame 21.

Steam floor mop 10 provides many advantages for ease of use because it eliminates the need for an electric water pump and an on/off switch to activate the electric water pump. Here, the user has more control over the amount of water needed to be discharged into the boiler and consequently, how much steam is needed by moving the mop forward and backwards. In addition, steam mop is designed as a low pressure or non-pressurized system so it is safer for the user to use. Further, since the amount of water routed to the boiler is controlled, the boiler can create steam in a short amount of time.

Figure 9:
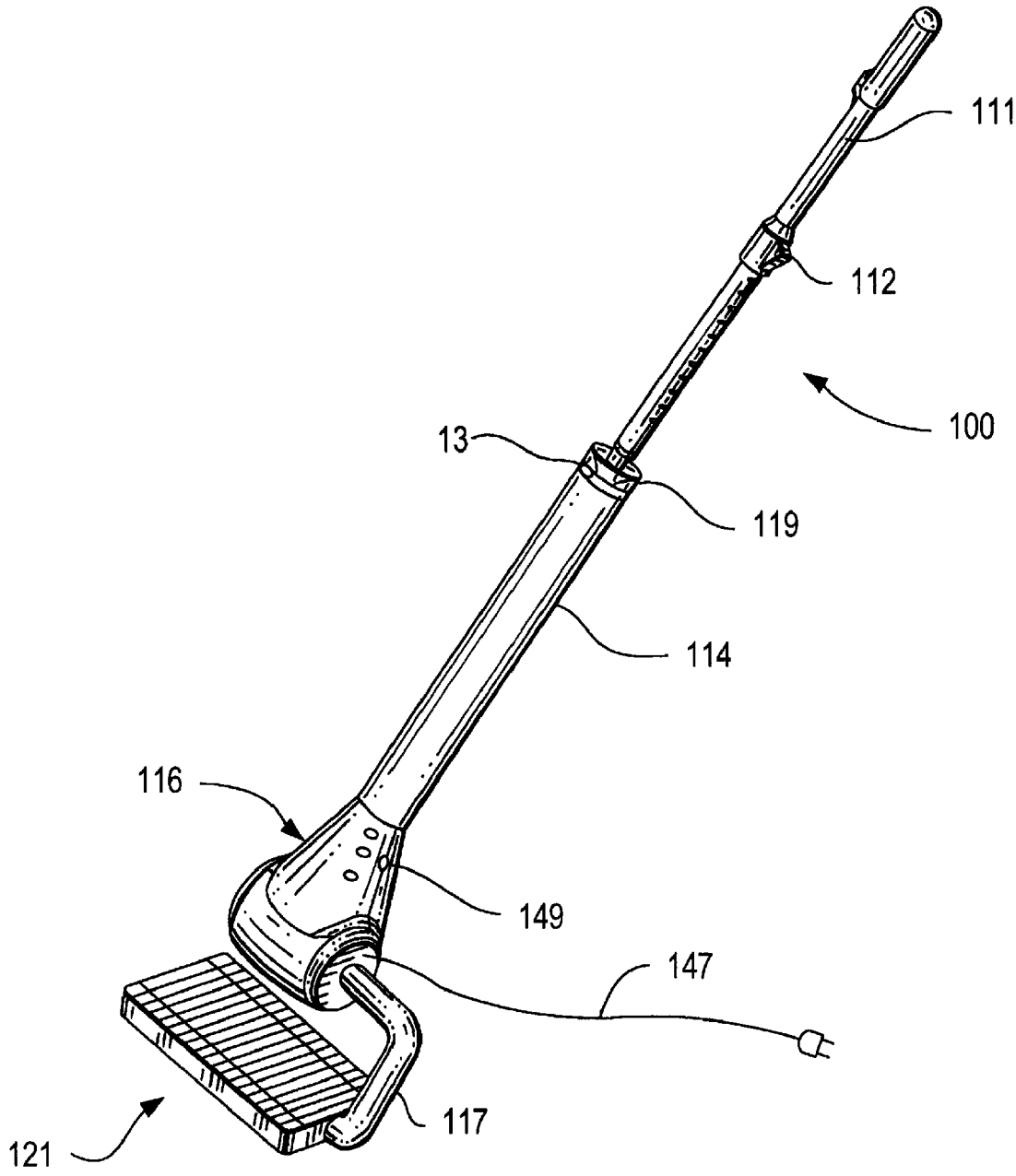
FIG. 9 is a perspective view of steam mop having one side arm including a steam pocket frame attachment for receiving a fabric steam pocket constructed and arranged in accordance with another embodiment of the invention.

FIG. 9 is a perspective view of a steam mop 100 constructed and arranged in accordance with an embodiment of the invention. All elements in FIG. 9 are present and identified by the same reference numerals plus 100. Mop 100 includes a steam pocket frame 121 mounted to a housing or main body 116 by a side arm 117. A water container or tank 114 is mounted to the upper part of housing 116 with a handle 111 and is connected to a boiler 146 by a pump 129 having a one-way outlet valve 137. A water container cover 119 is closed when handle 111 is installed. Water container 114 also has a handle release button 113 for ease of use to easily detach and attach handle 111. Any type of mechanical pump or some other means of transporting the water to the boiler may be used with steam mop 100. Preferably, pump 129 is a mechanical pump, such as a bellows pump or a piston pump, that is actuated by movement of mop 10 by a user pushing and pulling handle 111.

Figure 14:
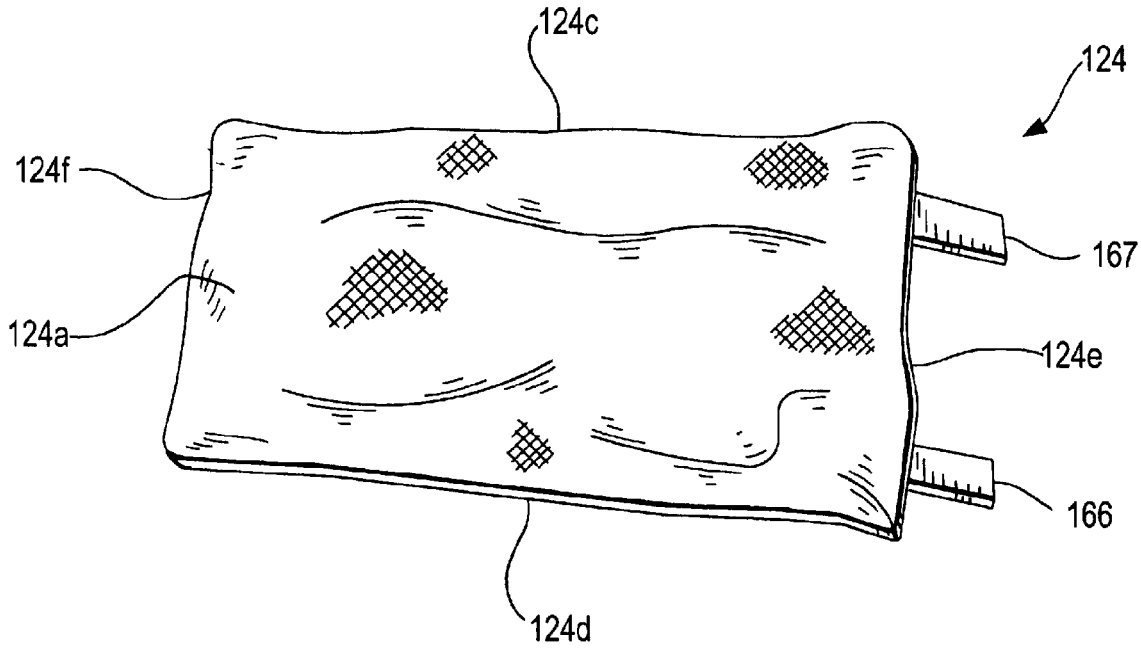
FIG. 14 is a perspective view of a fabric steam pocket suitable for use with the steam pocket frame attachment of FIG. 9.

Steam pocket frame 121 is rectangular in shape and includes a steam inlet coupling 122 at the side end and at the end of side arm 117. Steam generated in a steam boiler 146 shown in FIG. 10 dispenses steam into arm 117 and into frame 121. A rectangular fabric steam pocket 124 is mounted over frame 121 and is attached to the steam inlet coupling 122 side thereof by Velcro strips 166 and 167 as shown in FIG. 14.

Figure 10:
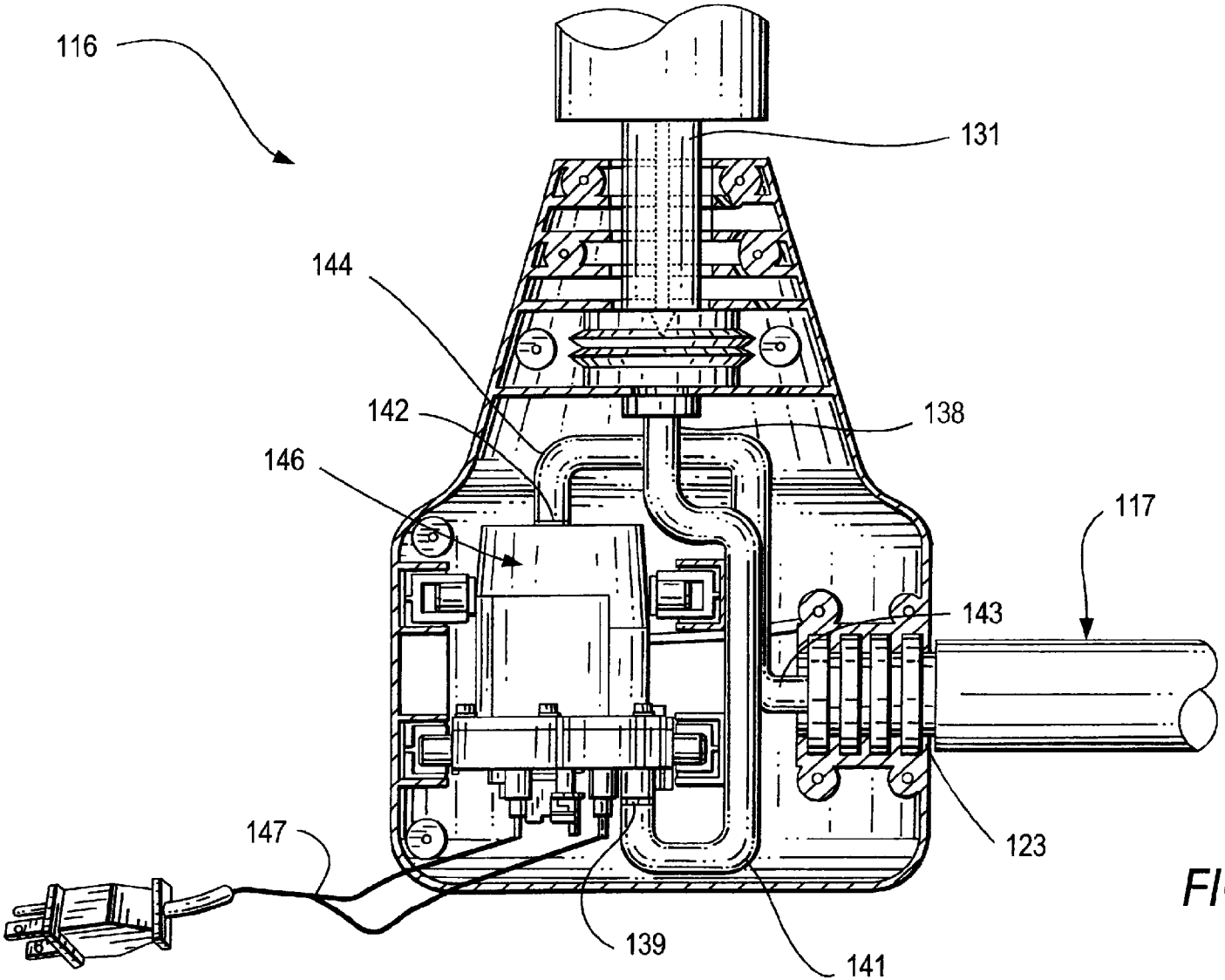
FIG. 10 is a front plan view of a housing and assembly for use with the steam mop of FIG. 9.

FIG. 10 is a front plan view of housing 116 of steam mop 100 including boiler 146 with a water hose 141 having a water inlet 138 and a water outlet 139. Water flows through one-way outlet valve 137 (shown in FIG. 4) to water inlet 138 and enters boiler 146 via through water hose 141. A steam hose 144 with a steam inlet 142 and a steam outlet 143 is coupled to boiler 146. Water inlet 138 and boiler 146 are connected to a power source by a power cord 147. Steam generated in boiler 146 exits through steam hose 144 with steam inlet 142 and steam outlet 143. Conveniently, main body 116 also includes an indicator light 149 to indicate when steam temperature is appropriate for use.

Figure 11:
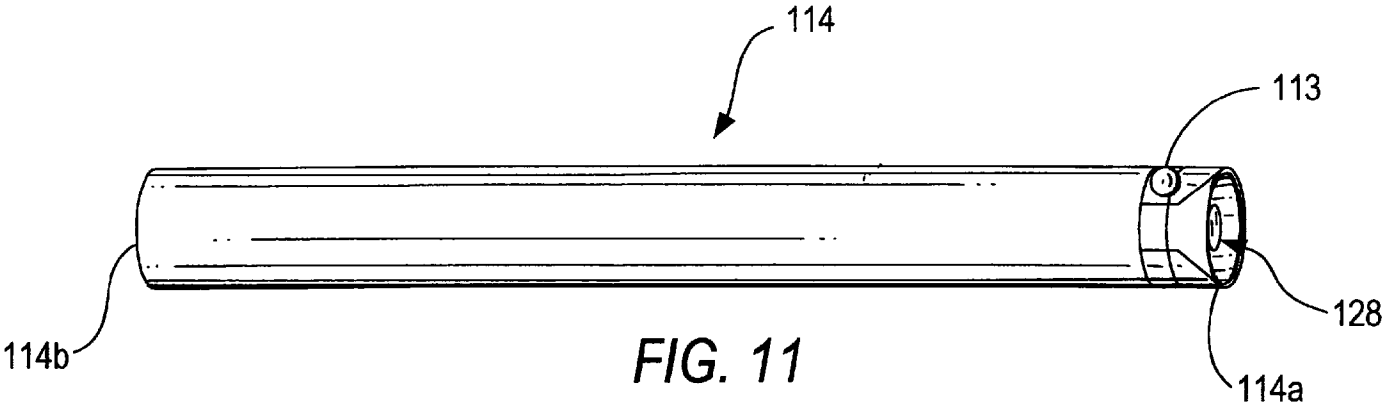
FIG. 11 is a plan view of a water container suitable for use with the steam mop and handle shown in FIG. 9.

Water container 114 suitable for use with the steam mop 100 is shown in FIG. 11. Water container 114 has a top portion 114*a* and a bottom portion 114*b*. Here, top portion 114*a* has a cone shaped open top 128 that functions as a funnel for the user to easily fill water into water container 114. Water container cover 19 shown in FIG. 12 covers cone shaped open top 128 of water container 114 when assembled. A user presses handle release button 113 to disassemble handle 111 from water container 114 for ease of filling container 114.

Figure 12:
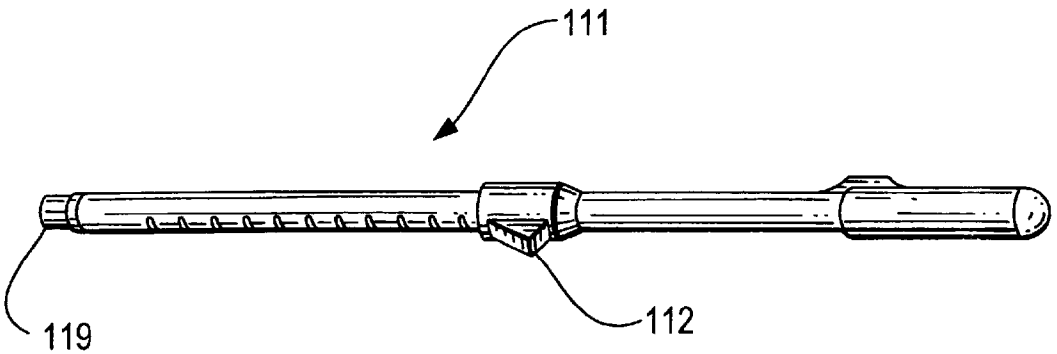
FIG. 12 is a perspective view of a handle suitable for use with the steam mop of FIG. 9.

FIG. 12 is a perspective view of handle 111 for use with steam mop 100. Handle 111 has an adjustable height button 112 and includes at the distal end of water container cover 119, which connects to water container 114. Preferably, handle 111 is a telescopic handle.

Figure 13A:
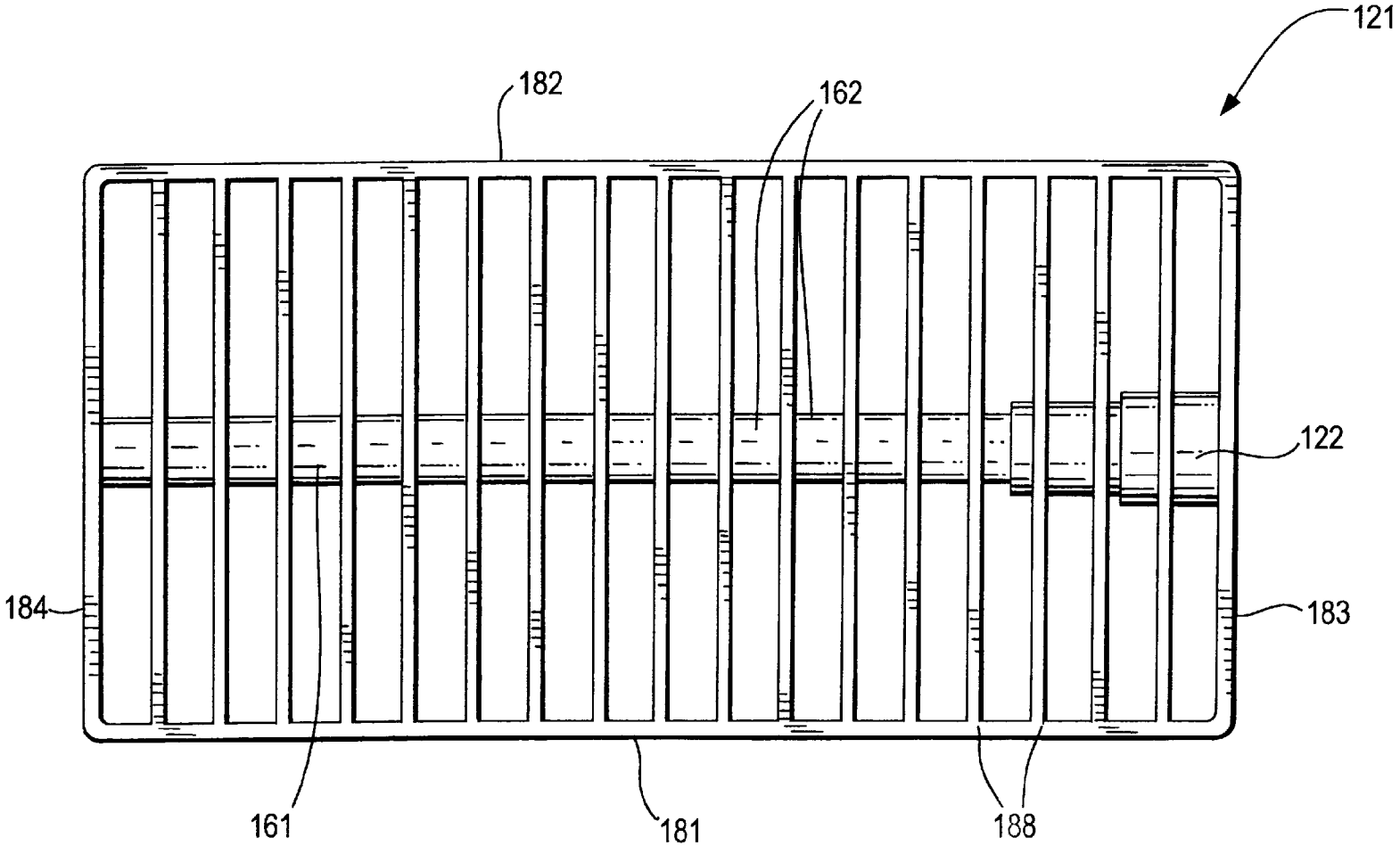
FIG. 13A is a top plan view of a steam pocket frame for use with the steam mop of FIG. 9.

FIG. 13A is a top perspective view of a rectangular steam pocket frame 121 including a front wall 181, a rear wall 182, a right side wall 183 and a left side wall 184. A plurality of baffles 188 extends from front wall 181 to rear wall 182 within frame 121. Baffles 188 are planar in shape and extend perpendicular from the front wall to the back wall of frame 121. Frame 121 has right side wall 183 with steam inlet coupling 122 connected thereto. Right side wall 183 also connects to arm 117. Frame 121 has a passageway 161 that extends from right side wall 183 to left side wall 184 perpendicular to baffles 188. Passageway 161 has a plurality of vents or openings 162 for distributing steam into the spaces between baffles 188 and to a steam pocket mounted thereon. An advantage of steam pocket frame 121 is that steam rises out of upper surface of frame 121 to provide a dry surface with the benefits of steam when cleaning.

Figure 13B:
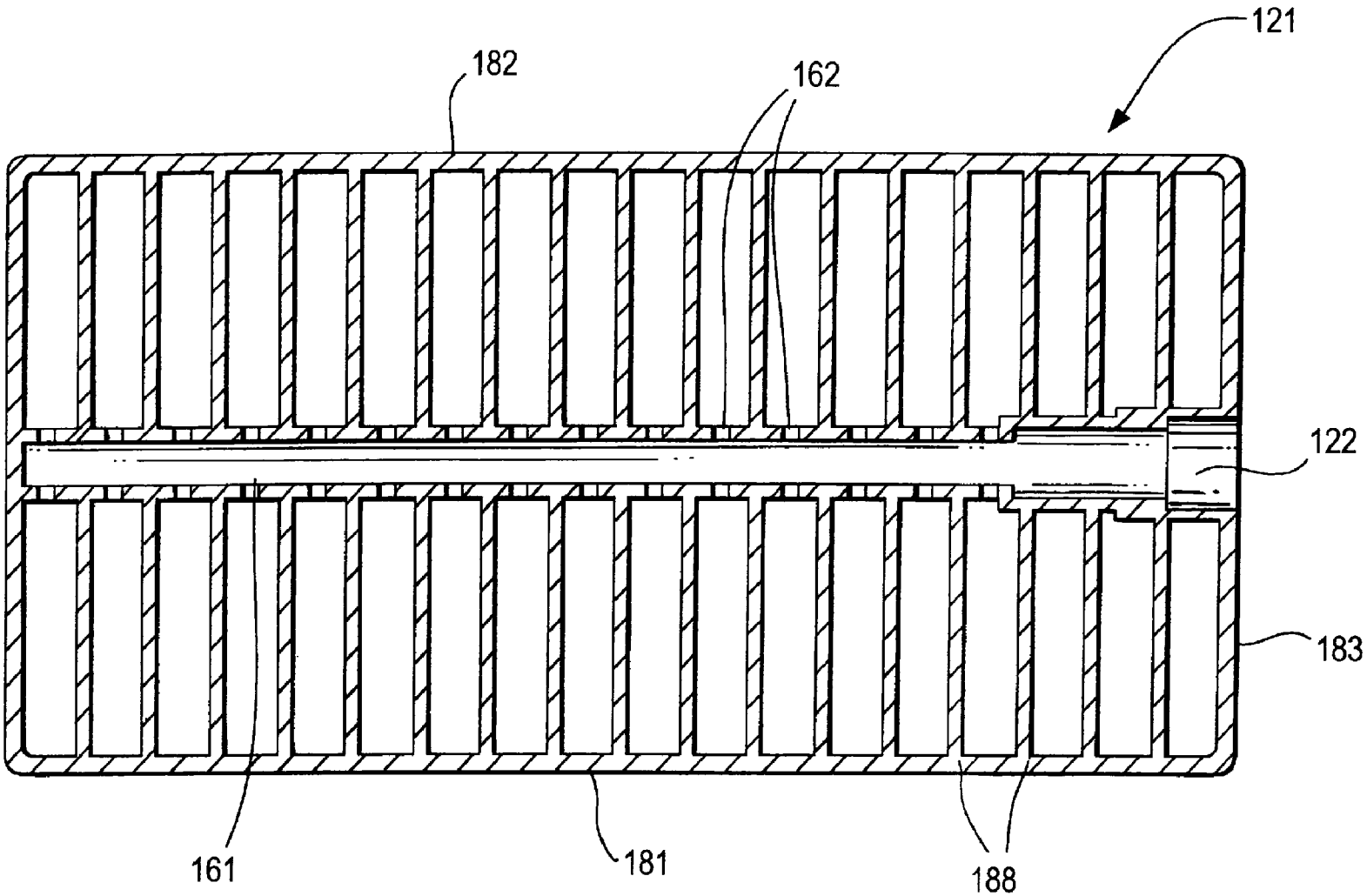
FIG. 13B is a plan view in cross-section of the steam pocket frame of FIG. 13A.

FIG. 13B is a plan view in cross-section of steam pocket frame attachment 121. The plurality of vents 162 are on both sides of passageway 161 and are parallel to baffles 188.

In FIG. 14, steam pocket 124 is configured to slip over frame 121. In this respect, it is formed of a first layer 124*a* and an opposed second layer 124*b* (not shown), each having a rectangular shape with two opposed long edges 124*c* and 124*d* and two opposed short sides 124*e* and 124*f*. Long edges 124*c* and 124*d* and one long side 124*f* are stitched to form pocket 124.

Straps 166 and 167 are fixed to an open side of steam pocket 124. In the preferred embodiment, fasteners 166 and 167 are Velcro-type fasteners. Alternatively, straps 166 and 167 may include buttons or snaps. In each case, straps 166 and 167 are placed over frame 121 and secured to hold pocket 124 in place when used to clean a floor or other surface.

In the illustrated embodiment, steam pocket 124 is a cloth or towel. It may be formed of any suitable fabric such as cotton or a synthetic fabric, such as polyester or polyolefin fiber. Preferably, the fabric of pocket 124 is a microfiber. Most preferably, the microfiber is a synthetic polyester microfiber.

Figure 15:
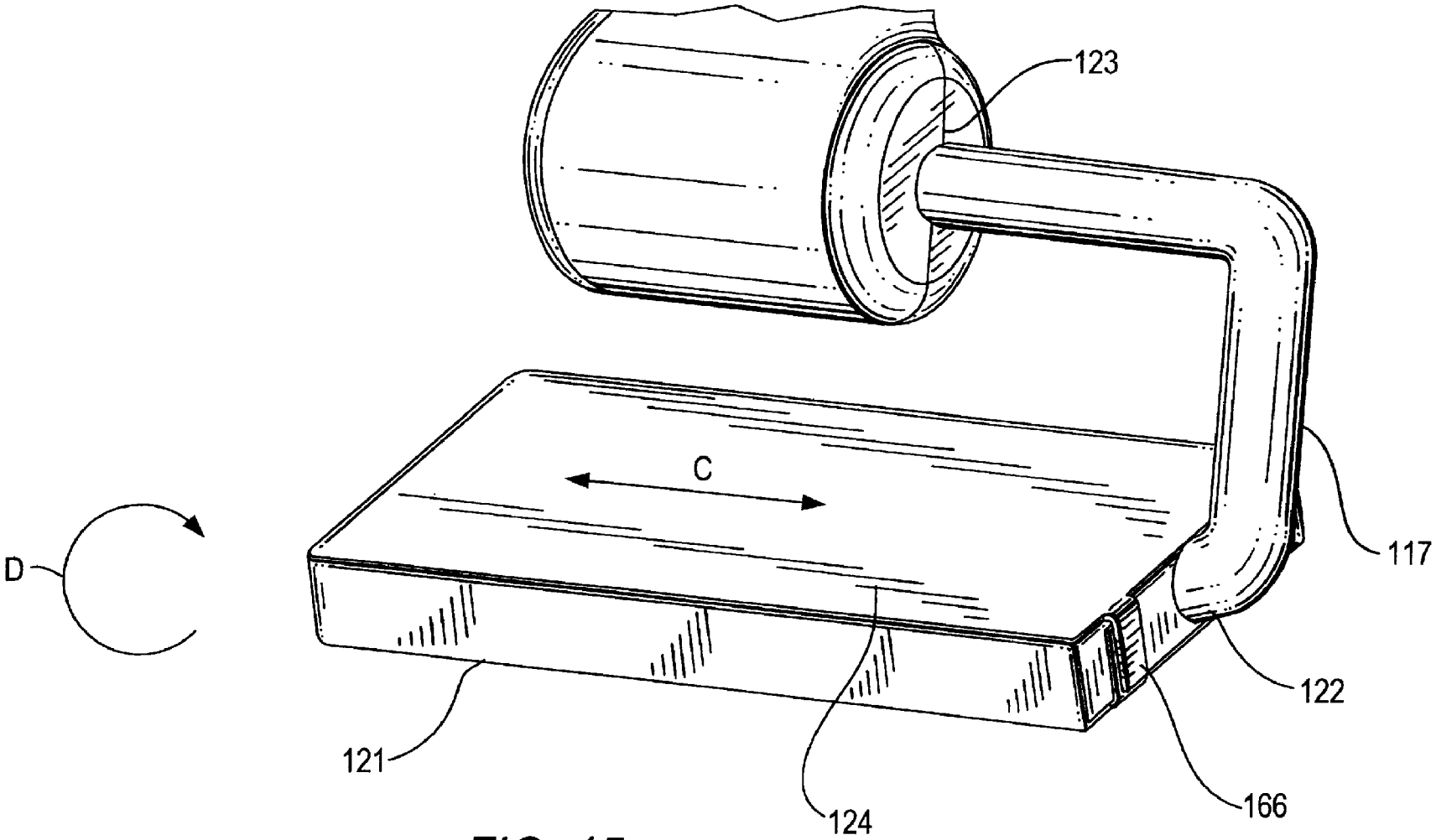
FIG. 15 is a perspective view of the mop of FIG. 9 with a fabric steam pocket mounted on the attachment frame.

FIG. 15 shows fabric steam pocket 124 mounted onto the steam pocket frame attachment 121 suitable for use with the steam pocket frame attachment of FIG. 9. This is also shown by the direction of Arrow C. Steam pocket frame attachment 121 may be rotated as shown by Arrow D so user may use both sides of steam pocket fabric 124 without having to reinstall steam pocket 124. This extends the time steam pocket 124 may be used without having to rinse and reinstall it.

Figure 16:
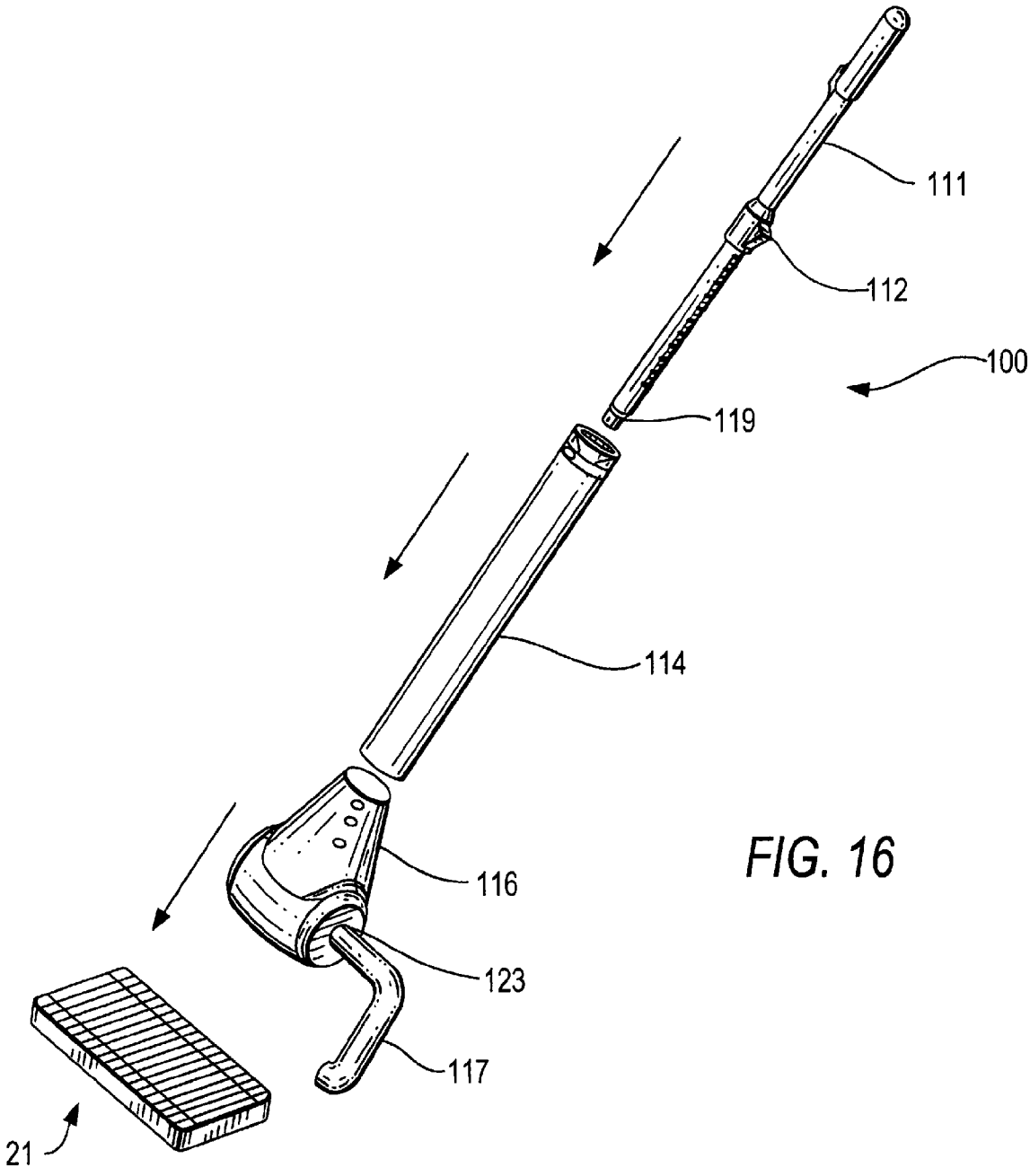
FIG. 16 exploded perspective view showing how the steam mop of the type shown in FIG. 9 is assembled.

FIG. 16 is an exploded perspective view showing how the steam floor mop of the type shown in FIG. 9 is assembled, which is indicated by arrows.

Figure 17:
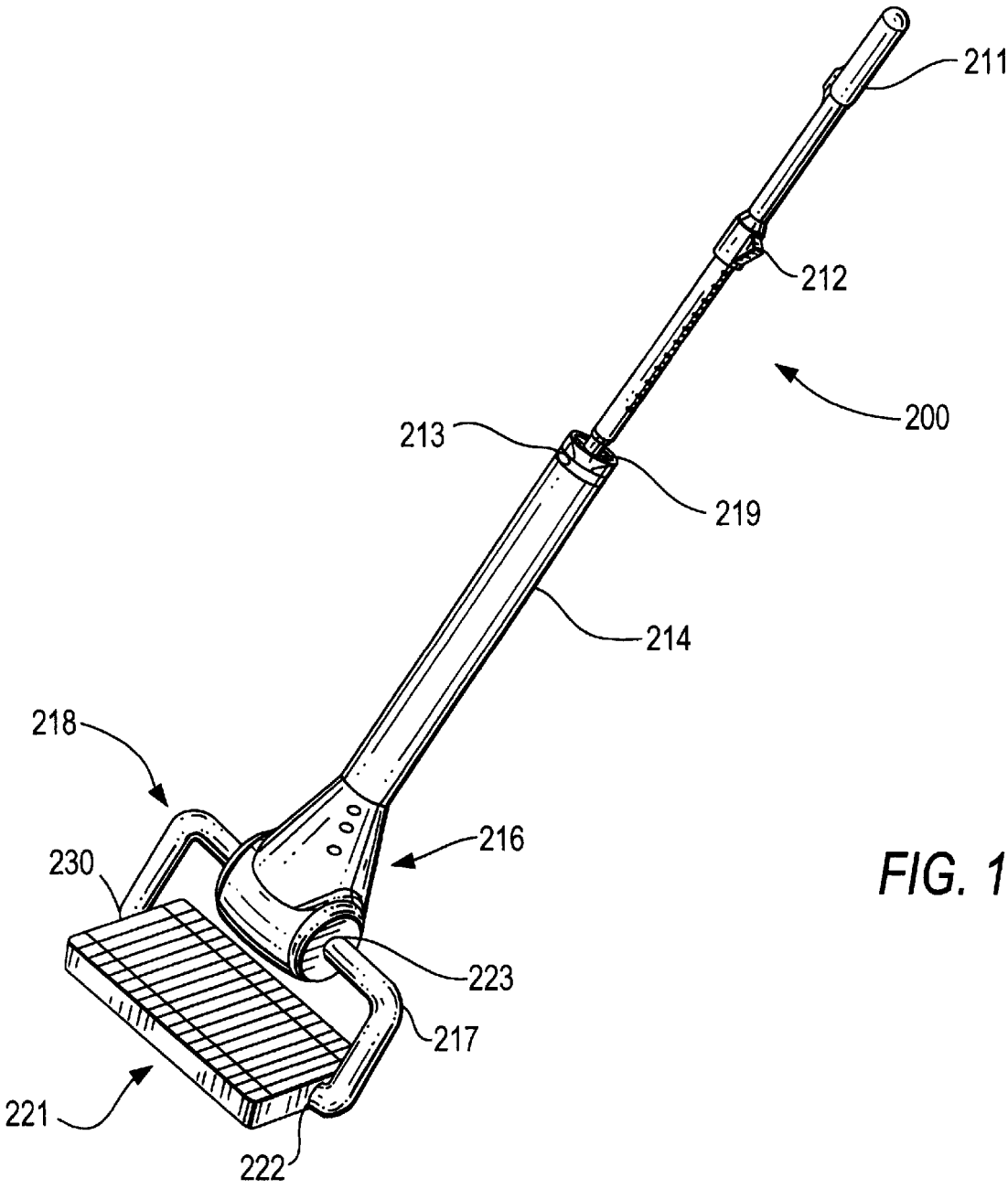
FIG. 17 is a perspective view of a steam mop including two side arms constructed and arranged in accordance with a further embodiment of the invention.

FIG. 17 is a perspective view of steam floor mop 200 including a steam pocket frame 221 for receiving a fabric steam pocket cover constructed and arranged in accordance with an embodiment of the invention. All elements in FIG. 11 are present and identified by the same reference numerals plus 200. Here, a steam pocket frame 221 is mounted on the distal end of two side arms 217 and 218 coupled to a housing 216. Steam pocket frame 221 is rectangular in shape and includes a steam inlet coupling 222 at side end. A steam outlet 223 dispenses steam into side arm 217 into a steam pocket frame fabric pocket 224. Frame 221 also has a left side wall that has a connector 230 that connects arm 218.

Figure 18:
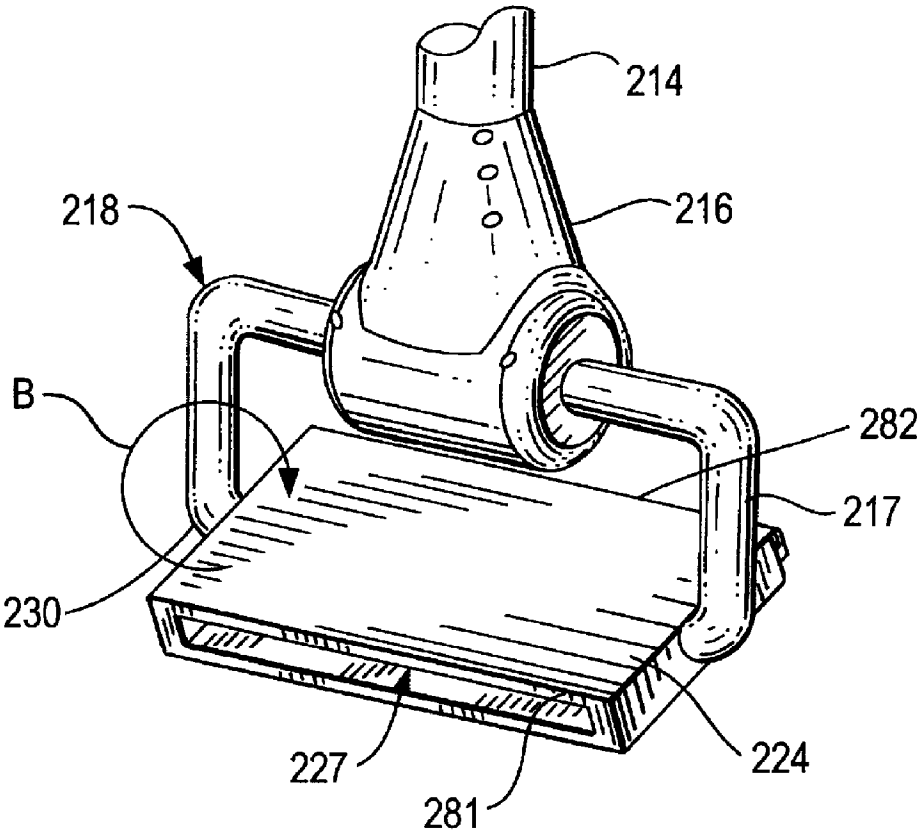
FIG. 18 is a perspective view showing a fabric steam pocket mounted onto the steam pocket frame of FIG. 17.

FIG. 18 is a perspective view of a rectangular fabric steam pocket 224 that shows how rectangular steam pocket fabric 224 is installed on steam pocket frame 221. Fabric steam pocket 224 is wrapped around the front wall 281 and back wall 282 circumference of steam pocket frame 221. This is also shown by the direction of Arrow B. Both top side and bottom side of rectangular steam pocket fabric 124 is secured by Velcro-type strip 227 to the front wall 281 or back wall 282 of steam pocket frame 221.

In the illustrated embodiment, steam pocket 224 is a cloth or towel. It may be formed of any suitable fabric such as cotton or a synthetic fabric, such as polyester or polyolefin fiber. Preferably, the fabric of steam pocket 224 is a microfiber. Most preferably, the microfiber is a synthetic polyester microfiber.

Steam inlet coupling 222 and connector 230 attached to steam pocket frame 221 and may be rotated as shown by Arrow B so user may use both sides of steam pocket fabric 224 without having to reinstall steam pocket 224. This extends the time steam pocket 224 may be used without having to rinse and reinstall it.

Figure 19:
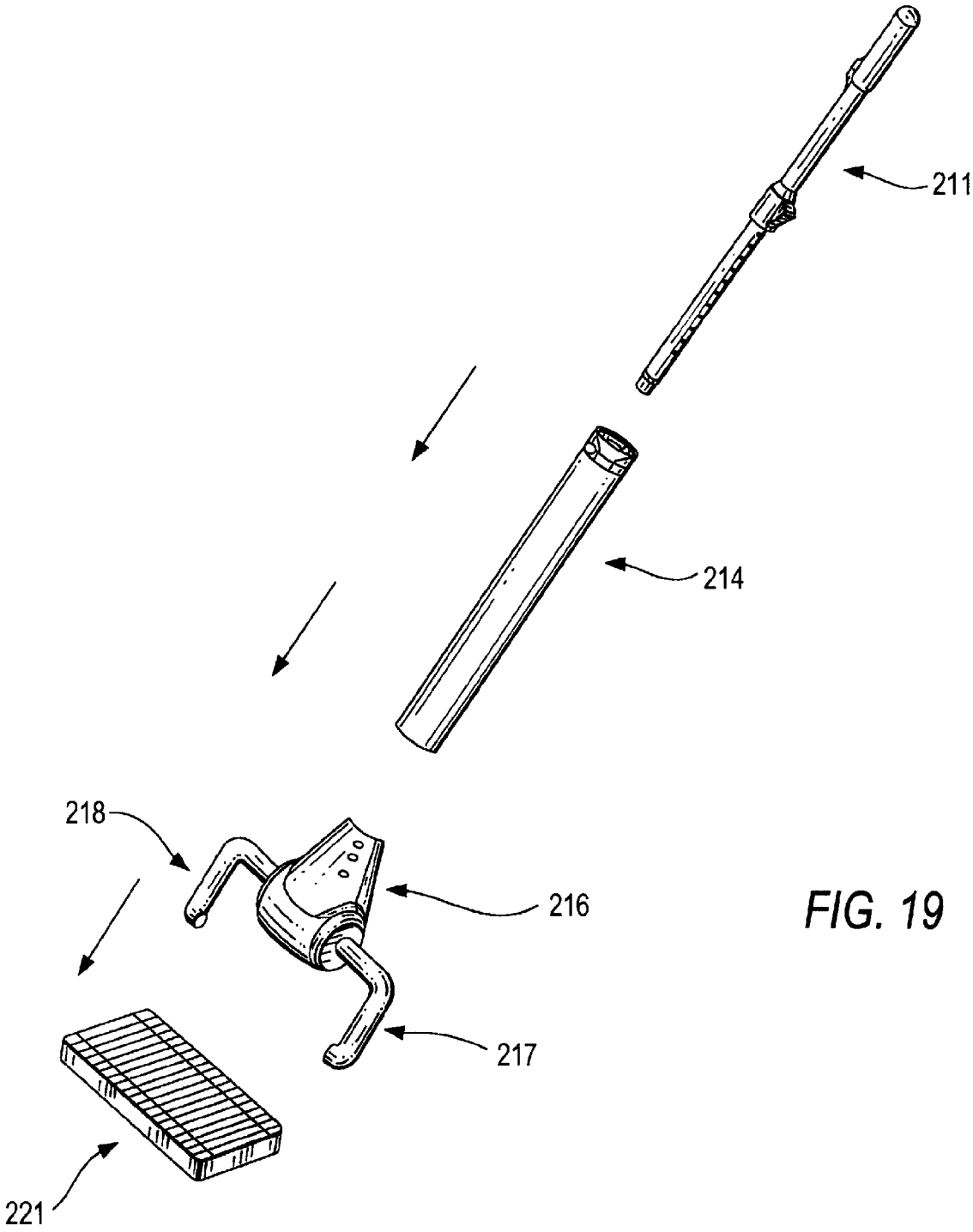
FIG. 19 is an exploded perspective view showing how the steam mop of FIG. 9 is assembled.

FIG. 19 is an exploded perspective view showing how the steam floor mop of the type shown in FIG. 17 is assembled, which is indicated by arrows.

Figure 20:
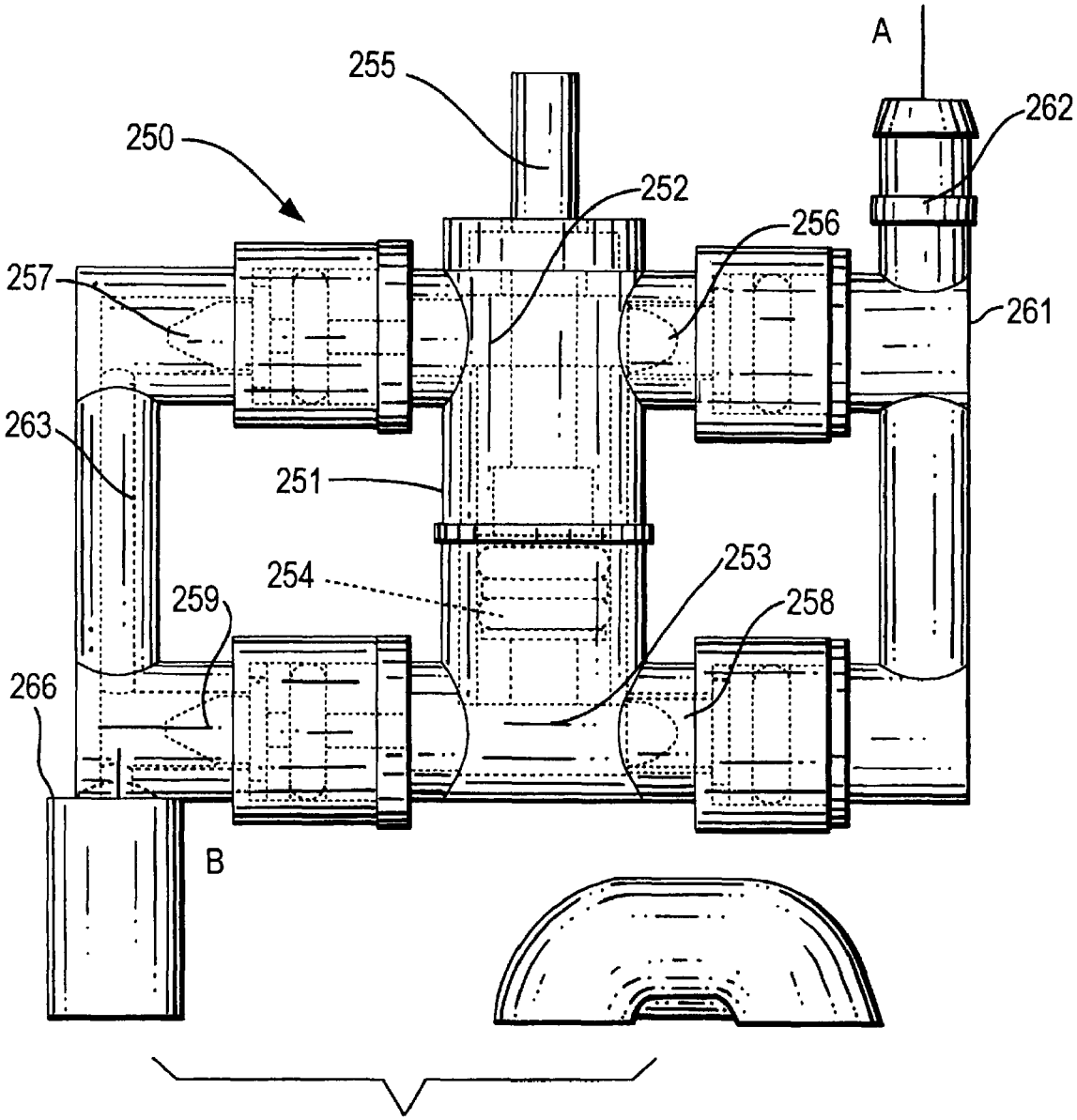
FIG. 20 is a schematic view of a two way valve suitable for use with the steam mop of FIG. 1.

Referring now to FIG. 20, in addition to valves 40 and 29 shown in FIGS. 3 and 4, respectively, a "two way" valve 250 may be used. Valve 250 will pump water when handle 11 is displaced both in the forward motion and also in the return backwards motion. Pump 250 includes a pump cylinder 251 having an upper chamber 252 and a lower chamber 253 divided by a piston 254 that is connected to a piston rod 255 which moves up and down in response to movement of handle 11.

Figure 21:
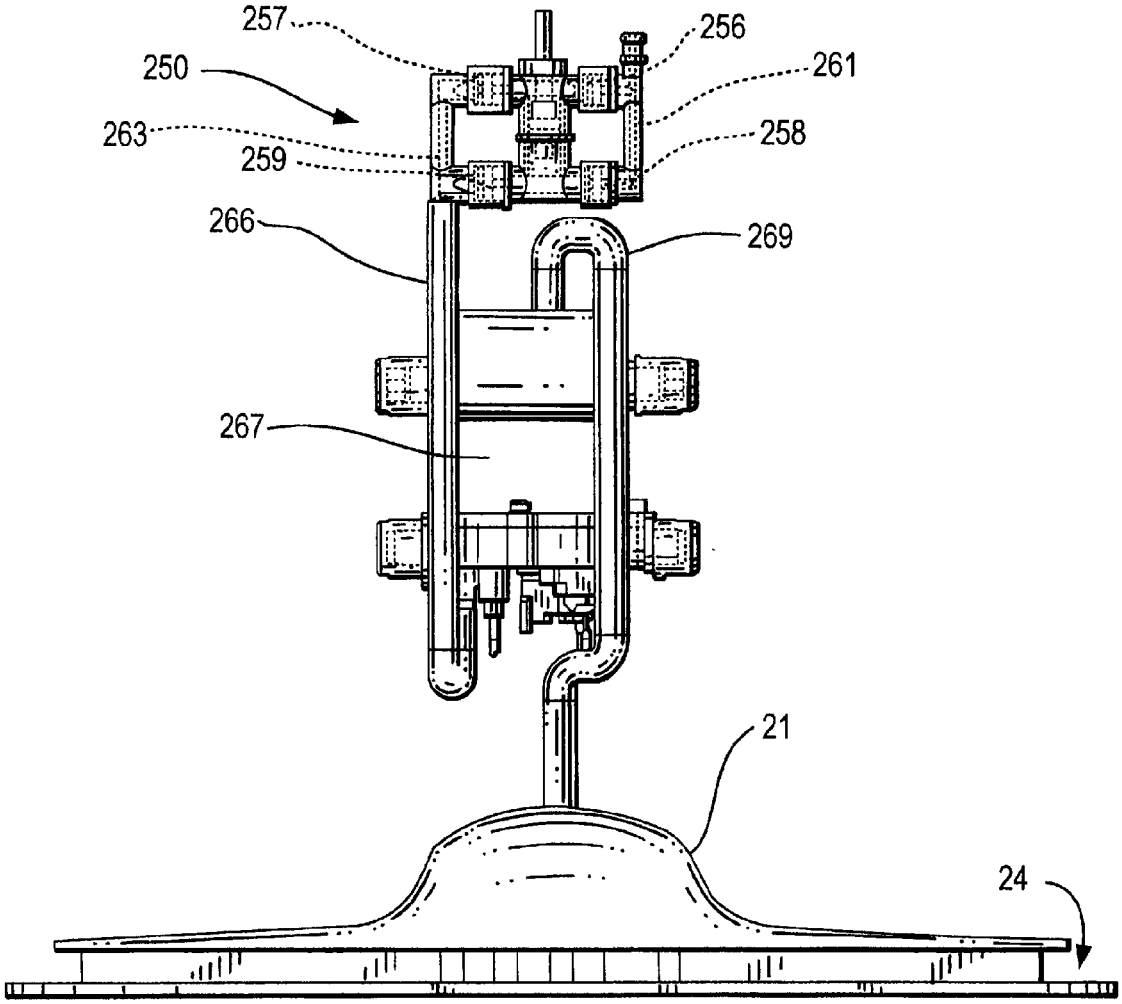
FIG. 21 is a schematic view showing a pump with the two way valve of FIG. 20 connected to the boiler with steam pad frame and fabric steam pad of the steam mop of FIG. 1.

A first inlet unidirectional duck bill valve 256 and a first outlet unidirectional duck bill valve 257 are connected to upper chamber 252. A second inlet unidirectional duck bill valve 258 and a second outlet unidirectional duck bill valve 259 are connected to lower chamber 253. As shown in FIG. 21, both inlet duck bill valves 256 and 258 are connected in parallel to a water inlet pipe 261 having a water inlet fitting 262 for securing a hose from reservoir 14. Water outlet duck bill valves 257 and 259 are connected in parallel to a water outlet pipe 263 that is secured to a water outlet hose 266 connected to a boiler 267 at an inlet 268. In order to create the pumping action to force water out of valves 257 and 259, volume changes in chambers 252 and 253 must be created.

A steam hose 269 is connected to steam generator 267 of any suitable design, such as boiler 46 in FIGS. 2 and 3 which can be used to distribute the steam in the desired pattern. Water inlet 261 can be connected with any suitable connection (rubber hose, direct connection to a water tank, etc) to the water supply to enable pump 251 to pump and deliver the water to steam generator 267.

As piston 254 is moving downward, the volume of lower chamber 253 decreases which causes the water which is inside to exit chamber 253 through duck bill valve 259. Water flow direction is determined by the direction of a duck bill valve. Water can flow only in one direction through a duck bill valve. At the same time water flows through outlet valve 259, the volume of chamber 252 increases. This increase of the volume causes water to flow from reservoir 14 into chamber 252 through inlet duck bill valve 256 as shown by arrow A.

Steam floor mop 10, 100 and 200 provides many advantages for ease of use because it eliminates the need for an electric water pump and an on/off switch to activate the electric water pump. Here, the user has more control over the amount of water needed to be discharged into the boiler and consequently, how much steam is needed by moving the mop forward and backwards. In addition, steam mop is designed as a low pressure or non-pressurized system so it is safer for the user to use. Further, since the amount of water routed to the boiler is controlled, the boiler can create steam in a short amount of time.

Steam pad frame 10 with fabric steam pad frame 21 and steam pocket frame 121 and 221 with fabric steam pad 24 and steam pocket fabric 124 and 224 in accordance with the invention provide vast improvements over placing a towel onto a bristle attachment for a steam cleaner, respectively. The invention avoids puncture of the cloth by the bristles and provides twice the cleaning surface. Moreover, the fabric cover is easily installed and replaced.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A steam mop having a pump that pumps water from a water container to a steam generator in response to movement of the mop handle with the steam fed to a fabric pocket cover in accordance with the invention provides a vast improvement over electrical pumps. The pump may include a two-way valve that pumps water in response to both the push and pull of the mop.

What is claimed is:

1. A steam mop, comprising:

a steam mop body including: a water container having a water inlet and a water outlet; a boiler having a boiler inlet for water and configured to generate steam; and a steam mop body steam outlet;

a non-electric, mechanical pump having a pump inlet connected to the water outlet and a pump outlet connected to the boiler inlet;

a steam frame in communication with the steam mop body steam outlet, the steam frame adapted to support a fabric cloth; and a handle which is constructed and arranged to be grippable by a user's hand to move the steam frame, the handle being connected to a pipe;

wherein movement of the handle in a longitudinal direction of the pipe to move the steam frame in a cleaning movement causes the mechanical pump to mechanically pump water from the water container to the boiler; and wherein the steam frame is configured and dimensioned to distribute steam substantially throughout the steam frame and onto the fabric cloth when the fabric cloth is mounted to the steam frame and steam is generated.

2. The steam mop of claim 1, wherein the steam frame is connected to the steam mop body by at least one tubular arm.

3. The steam mop of claim 1, wherein the steam frame comprises a plurality of baffles configured to direct steam to a surface of the fabric cloth when the fabric cloth is mounted to the steam frame.

4. The steam mop of claim 1, wherein the steam frame comprises a plurality of baffles configured to direct steam out of an upper surface of the steam frame and out of a lower surface of the steam frame.

5. The steam mop of claim 1, wherein the pump is a one-way pump.

6. The steam mop of claim 1, wherein the pump is a mechanical bellows pump with a one-way inlet valve and a one-way outlet valve.

7. The steam mop of claim 6, wherein the valves are substantially conical in shape and made of a substantially flexible material.

8. The steam mop of claim 1, wherein the pump is a mechanical piston pump with a one-way inlet valve and a one-way outlet valve.

9. The steam mop of claim 8, wherein the valves are substantially conical in shape and made of a substantially flexible material.

10. The steam mop of claim 1, further comprising the fabric cloth.

11. A steam mop, comprising:

a steam mop body having a water container for storing water, the water container having a water outlet;

a boiler with a water inlet; and a steam mop body steam outlet;

a user handle connected to the steam mop body;

a non-electric, mechanical pump having a pump inlet and a pump outlet, with the pump outlet connected to the boiler inlet;

the mechanical pump operatively connected to the handle;

a steam frame in communication with the steam mop body steam outlet, the steam frame adapted to support a fabric cloth, and wherein the user handle is constructed and arranged such that pushing the user handle moves the steam frame in a cleaning movement;

movement of the user handle mechanically activates the mechanical pump to mechanically pump water from the water container to the boiler for generation of steam to be distributed to the fabric cloth when the fabric cloth is mounted on the steam frame; and wherein the steam frame is configured and dimensioned to distribute steam substantially throughout the steam frame and onto the fabric cloth when the fabric cloth is mounted to the steam frame and steam is generated.

12. The steam mop of claim 11, including: a pump cylinder having a first end and a second end, with a first unidirectional inlet valve and a second unidirectional inlet valve at the first end, and a second unidirectional outlet valve and a second unidirectional outlet valve at the second end;

a piston dividing the cylinder into a first chamber and a second chamber, with the respective inlet and outlet valves connected thereto, with the first and second inlet valve connected to the water outlet, and the outlet valves connected to the steam generator;

whereby movement of the piston towards the second end expels water out of the second chamber through the second outlet valve and draws water into the first chamber through the first inlet valve, and movement of the piston towards the first end expels water out of the first chamber through the first outlet valve and draws water into the second chamber through the second inlet valve.

13. The steam mop of claim 11, wherein the water container is positioned between the pump inlet and the handle.

14. The steam mop of claim 11, wherein the pump is a mechanical bellows pump with a one-way inlet valve and a one-way outlet valve.

15. The steam mop of claim 14, wherein the valves are substantially conical in shape and made of a substantially flexible material.

16. The steam mop of claim 11, wherein the pump is a mechanical piston pump with a one-way inlet valve and a one-way outlet valve.

17. The steam mop of claim 11, wherein the steam frame is a steam pad frame having a steam outlet opening and a plurality of baffles extending over the steam outlet opening.

18. The steam mop of claim 17, wherein the steam pad frame further includes a plurality of vanes extending in a direction from the steam outlet opening toward an outer edge of the steam pad frame.

19. The steam mop of claim 11, wherein the steam frame comprises a plurality of baffles configured to direct steam out of an upper surface of the steam frame and out of a lower surface of the steam frame.

20. The steam mop of claim 11, wherein movement of the handle relative to the steam mop body mechanically activates the mechanical pump.

21. The steam mop of claim 11, further comprising the fabric cloth.

22. A steam pad frame for mounting a fabric steam pad for use with a steam mop, the frame comprising:

a top with a steam inlet opening;

a wall;

a steam outlet on the bottom surface of the top;

a plurality of baffles disposed over the steam outlet; and a plurality of vanes on the bottom surface of the top extending in the direction of the wall.

23. The steam pad frame of claim 22, including at least one securement member on the bottom surface of the top of the frame.

24. The steam pad frame of claim 22, wherein the wall includes a front wall, a rear wall, a right side wall, and a left side wall.

25. The steam pad frame of claim 22, wherein the frame has a substantially rectangular shape.

* * * * *